US011512477B2

(12) United States Patent
Restivo

(10) Patent No.: US 11,512,477 B2
(45) Date of Patent: Nov. 29, 2022

(54) TELESCOPING GUARDRAIL/FLIP DOOR

(71) Applicant: The Boeing Company, Chicago, IL (US)

(72) Inventor: Justin A. Restivo, Marysville, WA (US)

(73) Assignee: The Boeing Company, Chicago, IL (US)

( * ) Notice: Subject to any disclaimer, the term of this patent is extended or adjusted under 35 U.S.C. 154(b) by 490 days.

(21) Appl. No.: 16/693,012

(22) Filed: Nov. 22, 2019

(65) Prior Publication Data

US 2021/0156152 A1 May 27, 2021

(51) Int. Cl.
*E04F 11/18* (2006.01)
*E04G 5/14* (2006.01)
*E06B 11/00* (2006.01)

(52) U.S. Cl.
CPC ..... *E04F 11/18* (2013.01); *E04G 5/14* (2013.01)

(58) Field of Classification Search
CPC ... E04F 11/18; E04G 5/14; E04G 1/00; E04G 2001/155; E06B 3/38; E06B 11/00; E05Y 2201/434; B64F 5/10
See application file for complete search history.

(56) References Cited

U.S. PATENT DOCUMENTS 3,596,735 A * 8/1971 Denier ..... B66F 11/042 182/69.5
3,666,045 A * 5/1972 Olsen ..... B61D 19/023 182/20
3,825,095 A * 7/1974 Clark ..... B66F 11/04 182/2.1
4,301,627 A * 11/1981 Wilson ..... E04H 3/28 52/6
4,688,768 A * 8/1987 Lyons, Sr. ..... E04F 11/18 182/106
5,921,531 A * 7/1999 Early ..... B60R 3/005 105/457
6,045,157 A * 4/2000 Poulin ..... B60R 3/005 280/830
6,138,812 A * 10/2000 Kimener ..... E06B 11/00 49/133
7,140,467 B2 * 11/2006 Cook ..... B60R 3/005 182/141
7,216,741 B2 * 5/2007 MacDonald ..... B66F 11/04 182/113
8,051,951 B2 * 11/2011 Bennett ..... B61K 13/00 182/132

(Continued)

*Primary Examiner* — Brian D Mattei
*Assistant Examiner* — Kathleen M. McFarland
(74) *Attorney, Agent, or Firm* — McDonnell Boehnen Hulbert & Berghoff LLP

(57) ABSTRACT

The present disclosure relates systems and methods involving movable/adjustable platforms and/or guardrails. An example system a bracket configured to be coupled to a fixed structure having a walking surface and a flip door portion rotatably coupled to the bracket. The system also includes a guardrail portion extendibly coupled to the flip door portion and a telescopic linkage further coupling the flip door portion to the guardrail portion. The system additionally includes a locking mechanism with a locking pin. The locking pin is configured to maintain the flip door portion in a raised configuration. The system is configured to be adjusted between the raised configuration and a platform configuration.

20 Claims, 31 Drawing Sheets

Raised Flip Door with Extended Guardrail Configuration

(56) References Cited

U.S. PATENT DOCUMENTS 8,246,285 B2 * 8/2012 Maguin ..... B66F 7/0625 182/113
8,479,882 B2 * 7/2013 DuBose ..... B60P 1/00 182/113
8,627,925 B2 * 1/2014 Webster ..... E04G 5/14 182/148
9,027,712 B2 * 5/2015 Melton ..... B65G 69/22 182/36
9,080,336 B1 * 7/2015 Yantis ..... E04G 3/24
9,273,475 B1 * 3/2016 DuBose ..... B60P 1/00
9,366,042 B2 * 6/2016 Weston ..... E04G 1/30
9,409,755 B2 * 8/2016 Melton ..... B66F 11/04
9,481,314 B2 * 11/2016 Levi ..... B60R 9/058
9,637,975 B2 * 5/2017 Melton ..... E06C 1/39
10,087,641 B2 * 10/2018 Harmon ..... E04G 5/14
10,184,256 B2 * 1/2019 Melic ..... E04G 21/3228
10,279,724 B2 * 5/2019 Roth ..... E04B 1/003
10,724,256 B1 * 7/2020 Anderson ..... E06C 1/39
10,730,372 B2 * 8/2020 Roth ..... B60P 1/435
10,822,818 B2 * 11/2020 Harmon ..... E04G 5/14
10,968,643 B2 * 4/2021 Legua Gracia ..... E04G 3/246
11,007,944 B1 * 5/2021 Hanser ..... E04G 5/14
11,156,008 B2 * 10/2021 Phan ..... B64F 5/60
11,319,713 B2 * 5/2022 O'Keefe ..... E04G 3/28
2003/0020253 A1 * 1/2003 Albert Bosman et al. ..... B60R 3/005 280/164.1
2010/0294592 A1 * 11/2010 Crook ..... B66F 11/044 182/113
2012/0006619 A1 * 1/2012 DuBose ..... E04G 5/14 182/113
2014/0020978 A1 * 1/2014 Weston ..... E04G 1/30 182/102
2014/0261098 A1 * 9/2014 Giemza ..... B65G 69/24 108/44
2014/0367195 A1 * 12/2014 Melton ..... E06C 1/39 182/115
2015/0034418 A1 * 2/2015 Melton ..... B66F 17/006 182/113
2018/0016809 A1 * 1/2018 Hyland ..... E04H 17/02
2018/0135307 A1 * 5/2018 Moran ..... E04G 21/3228
2018/0347275 A1 * 12/2018 Horn ..... B66F 11/00
2019/0270364 A1 * 9/2019 Roth ..... B60J 5/107
2019/0330034 A1 * 10/2019 Crook ..... B66F 13/00
2019/0360219 A1 * 11/2019 O'Keefe ..... E04G 3/28
2020/0080315 A1 * 3/2020 Shelton ..... E04F 11/1834
2020/0087932 A1 * 3/2020 Phan ..... B66F 11/04
2020/0270107 A1 * 8/2020 Hokanson ..... E04G 1/18
2020/0370370 A1 * 11/2020 Satrom ..... E06B 11/00
2021/0017774 A1 * 1/2021 Phan ..... E04G 1/00
2021/0078845 A1 * 3/2021 Xu ..... B66F 17/006
2021/0156152 A1 * 5/2021 Restivo ..... E04F 11/18
2021/0293028 A1 * 9/2021 Owen ..... F16B 7/187
2021/0293029 A1 * 9/2021 Phan ..... E04F 11/1865
2022/0042327 A1 * 2/2022 Depot ..... E04G 3/18
2022/0134242 A1 * 5/2022 Vamos ..... E06B 11/026 104/28

* cited by examiner

Raised Flip Door with Extended Guardrail Configuration

Raised Flip Door with Extended Guardrail Configuration

Raised Flip Door with Retracted Guardrail Configuration

Raised Flip Door with Extended Guardrail Configuration

Raised Flip Door with Extended Guardrail Configuration

Platform Configuration

Raised Flip Door with Extended Guardrail Configuration

TELESCOPING GUARDRAIL/FLIP DOOR

FIELD

The present disclosure generally relates to systems and methods involving adjustable walkway platforms and/or movable guardrails.

BACKGROUND

During their manufacture in an airplane production facility, aircraft move along the production line between different stages of assembly. This periodic (e.g., daily) movement is called "pulsing" the production line.

In some stages of assembly, personnel may access elevated portions of the aircraft by way of fixed deck platforms positioned within a few feet from the respective sides of the aircraft's fuselage. In such scenarios, movable deck platforms (e.g., flip doors) may be coupled to the fixed deck platforms and may be operable to provide personnel with the remaining platform access up to the body of the aircraft.

Prior to pulsing the production line, the movable deck platforms may be manually rotated (e.g., raised upward or lowered downward away from the fuselage) so as to provide sufficient clearance for airplane movement along the production line. To avoid falls from the fixed deck platform at this stage, removable guardrails can be manually installed near the end of the fixed deck platform.

Once a new airplane is in a proper position along the production line, the guardrails may be manually removed and the movable deck platform could be reinstalled or rotated to a horizontal position to once again close the gap between the fixed deck platform and the aircraft fuselage and provide standing access for personnel immediately next to the fuselage.

Frequent handling of the removable guardrail sections, which can weigh 40 pounds or more, can lead to repetitive lift injuries. Furthermore, personnel who install and remove the guardrails can be at particular risk of falling or dropping the guardrails.

SUMMARY

In an aspect, a system is described. The system includes a bracket configured to be coupled to a fixed structure having a walking surface. The system also includes a flip door portion rotatably coupled to the bracket and a guardrail portion extendibly coupled to the flip door portion. The system includes a telescopic linkage further coupling the flip door portion to the guardrail portion and a locking mechanism with a locking pin. The locking pin is configured to maintain the flip door portion in a raised configuration. The system is configured to be adjusted between the raised configuration and a platform configuration.

In an aspect, a deck platform is described. The deck platform includes a fixed deck platform portion having a walking surface. The deck platform also includes a movable deck platform portion. The movable deck platform portion includes a bracket configured to be coupled to the fixed deck platform portion. The movable deck platform portion additionally includes a flip door portion rotatably coupled to the bracket and a guardrail portion extendibly coupled to the flip door portion. The movable deck platform portion further includes a telescopic linkage further coupling the flip door portion to the guardrail portion and a locking mechanism with a locking pin. The locking pin is configured to maintain the flip door portion in a raised configuration. The movable deck platform portion is configured to be adjusted between the raised configuration and a platform configuration.

In a further aspect, a method is described. The method includes receiving, from a remote unit, information indicative of a desired configuration or a desired movement of a flip door portion and a guardrail portion with respect to a fixed structure having a walking surface. The flip door portion is rotatably coupled to a bracket attached to the fixed structure. The guardrail portion is rotatably coupled to the flip door portion. The method also includes determining, based on the received information, that the desired configuration or the desired movement includes at least one of: a raised configuration or a platform configuration with respect to the walking surface. The method also includes moving the flip door portion and the guardrail portion according to the desired configuration or the desired movement.

Other aspects, examples, and implementations will become apparent to those of ordinary skill in the art by reading the following detailed description with reference, where appropriate, to the accompanying drawings.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying drawings, wherein:

DETAILED DESCRIPTION

I. Overview

Figure 1:
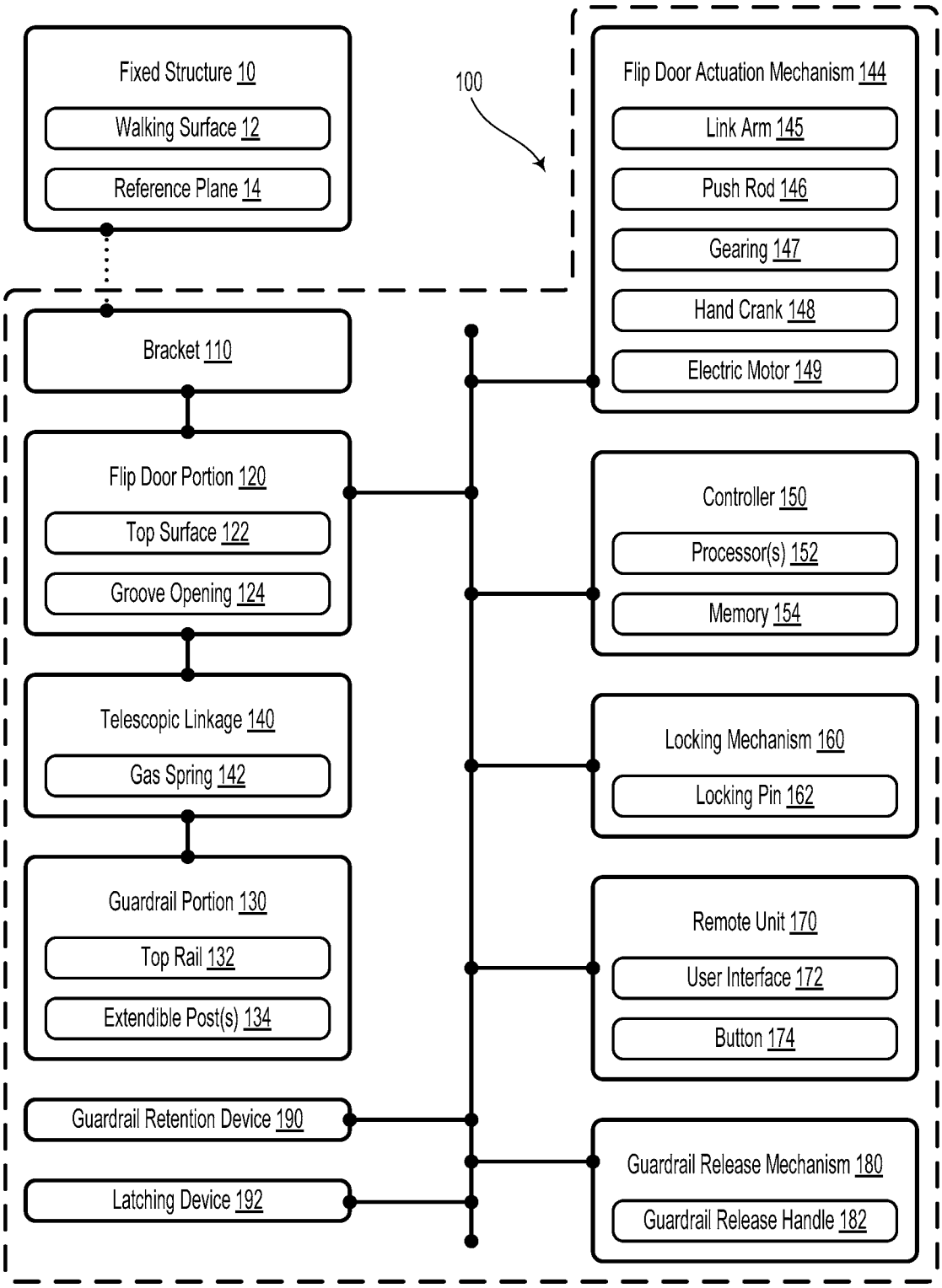
FIG. 1 illustrates a system, according to an example implementation.

Example methods, devices, and systems are described herein. It should be understood that the words "example" and "exemplary" are used herein to mean "serving as an example, instance, or illustration." Any example or feature described herein as being an "example" or "exemplary" is not necessarily to be construed as preferred or advantageous over other examples or features. Other examples can be utilized, and other changes can be made, without departing from the scope of the subject matter presented herein.

Thus, the examples described herein are not meant to be limiting. Aspects of the present disclosure, as generally described herein, and illustrated in the figures, can be arranged, substituted, combined, separated, and designed in a wide variety of different configurations, all of which are contemplated herein.

Further, unless context suggests otherwise, the features illustrated in each of the figures may be used in combination with one another. Thus, the figures should be generally viewed as component aspects of one or more overall examples, with the understanding that not all illustrated features are necessary for each example.

The present disclosure relates to an adjustable guardrail/flip door system and a movable deck platform that may improve safety and efficiency in such scenarios. Namely, an example system could include a bracket configured to couple to a fixed structure (e.g., a fixed deck platform). The system also includes a flip door portion rotatably coupled to the bracket and a guardrail portion extendibly coupled to the flip door portion. A telescopic linkage further couples the flip door portion to the guardrail portion. Furthermore, a locking mechanism with a locking pin may be utilized to maintain the flip door portion in a raised configuration. Such a system could be configured to be adjusted between the raised configuration and a lowered configuration (e.g., a platform configuration).

Such a flip door/guardrail system could be implemented in at least three ways. First, the system could be operated manually by personnel who could directly raise and lower the guardrail portion and controllably raise and lower the flip door portion. Second, the system could be operated in a "mechanically-assisted" mode where personnel could operate a hand crank or another type of mechanism to mechanically control the raising or lowering of the flip door portion. Third, the system could be operated in a "fully automated" mode where the operator could operate the system via a remote controller to control the configuration of the system.

In some embodiments, the systems and deck platforms described herein could be intended to comply with various federal and state safety guidelines, such as, but not limited to, current Occupational Safety and Health Administration (OSHA) Regulation 1910.29 (Fall protection systems) (See e.g., Federal Register Volume 81, Issue 223, Nov. 18, 2016). Other United States and international safety standards could be addressed by way of the present systems and deck platforms as well.

II. Example Systems

FIG. 1 illustrates a system 100, according to an example implementation. The system 100 includes a bracket 110 configured to be coupled to a fixed structure 10 having a walking surface 12. As described herein, the various elements of system 100 could be formed from round and/or square metal tubing, rods, pins, or bars. Some elements of system 100 could be formed from L- or C-shaped metal (e.g., angle or channel structural materials). Additionally or alternatively, the various elements of system 100 could be formed from one or more materials such as aluminum, steel, and/or another material. Furthermore, it will be understood that such parts could additionally or alternatively be formed from machined parts.

The system 100 also includes a flip door portion 120 rotatably coupled to the bracket 110. As described herein, elements that are "rotatably coupled" to one another could be coupled by way of a pin, a rotary bearing; or at least one rotary bushing and a stripper bolt. Other types of flexible and/or adjustable couplings are contemplated to join the relevant elements in a rotatable fashion. For example, it will be understood that other types of rotatable couplings are contemplated herein. Without limitation, elements of system 100 could be rotatably coupled to one another by way of a straight or articulated axle, a clevis pin, a plain bearing (e.g., sleeve bearing/bushing), a ball bearing, or roller bearing, among other possibilities.

The system 100 also includes a guardrail portion 130 extendibly coupled to the flip door portion 120. In various embodiments, the guardrail portion 130 could include a top rail 132 and a plurality of extendible posts 134 coupled to the top rail 132 and the flip door portion 120.

As described herein, elements that are "extendibly coupled" to one another could be coupled in a telescoping manner. For example, a telescoping joint or telescoping coupling could include two elements configured such that one part may slide out from another, lengthening an object (such as a telescope, an antenna, or a lift arm of an aerial work platform) from its rest state. In some embodiments, the telescoping movement can be achieved by manual actuation, a jack screw attached to an electric motor, hydraulics, and/or springs. However, other ways to actuate the telescoping movement could include cables/ropes and pulleys. In some embodiments, elements that are "extendibly coupled" to one another could be coupled by way of a linear sliding joint (e.g., a drawer slide rail). In such scenarios, the sliding joint could include one or more ball bearings or cylindrical bearings that could facilitate a sliding motion between a first element and a second element so as to "extend" or "retract" with respect to one another. Other ways to extend or retract elements with respect to one another are contemplated and possible within the scope of the present disclosure.

In some embodiments, the system 100 may include a telescopic linkage 140 further coupling the flip door portion 120 to the guardrail portion 130. In such scenarios, the telescopic linkage 140 could include a plurality of gas springs 142 that are configured to provide an extending force between the guardrail portion 130 and the flip door portion 120.

In various embodiments, the system 100 additionally includes a locking mechanism 160 with a locking pin 162. In such scenarios, the locking mechanism 160 could be operable through a groove opening 124 of a top surface 122 of the flip door portion 120. The locking pin 162 is configured to maintain the flip door portion 120 in a raised configuration. In such scenarios, the system 100 could be configured to be adjusted between the raised configuration and a platform configuration.

In example embodiments, the walking surface 12 defines a reference plane 14. In such scenarios, the raised configuration includes the flip door portion 120 being disposed substantially perpendicular to the reference plane 14 and the guardrail portion 130 being extended away from the flip door portion 120.

By the term "substantially" used herein, it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

Additionally or alternatively, the platform configuration could include the flip door portion 120 extending substantially parallel along the reference plane 14 and the guardrail portion 130 being stowed under a top surface 122 of the flip door portion 120.

In some embodiments, system 100 may additionally include a guardrail release mechanism 180. The guardrail release mechanism 180 could be configured to operably maintain the guardrail portion 130 in a retracted guardrail configuration or release the guardrail portion 130 to an extended guardrail configuration. In example embodiments, the guardrail release mechanism 180 could be operable by way of a guardrail release handle 182. In such scenarios, the guardrail release handle 182 could be operable from a top surface 122 of the flip door portion 120.

In various embodiments, system 100 may include a guardrail retention device 190. In such scenarios, the guardrail retention device 190 could be configured to retain the guardrail portion 130 in the retracted guardrail configuration. Furthermore, the guardrail release mechanism 180 could be configured to operably release the guardrail retention device 190.

In example embodiments, system 100 could optionally include a latching device 192. In such scenarios, the latching device 192 could be configured to allow operation of the locking mechanism 160 only if the guardrail portion 130 is in a retracted guardrail configuration.

In some embodiments, system 100 could include a flip door actuation mechanism 144. The flip door actuation mechanism 144 could be configured to move the flip door portion 120 between the raised configuration and the platform configuration. By way of example, the flip door actuation mechanism 144 could include a link arm 145 coupled to the flip door portion 120. In such scenarios, the flip door actuation mechanism 144 may also include a push rod 146 coupled to the link arm 145. Additionally or alternatively, the flip door actuation mechanism 144 could include gearing 147 coupled to the push rod 146.

In various embodiments, the flip door actuation mechanism 144 could additionally or alternatively include a hand crank 148 coupled to the gearing 147. In some such scenarios, the hand crank 148 could be accessible from a top surface 122 of the flip door portion 120.

In some embodiments, the flip door actuation mechanism 144 could alternatively include an electric motor 149 coupled to the gearing 147. As an example, the flip door actuation mechanism 144 could include an electric ball-screw linear actuator comprising an actuator arm with a throw range between 100 mm to 300 mm. Other throw ranges are possible and contemplated. Furthermore, other types of linear actuators are possible and contemplated, including, without limitation, pneumatic actuators, rotary actuators, or hydraulic actuators.

In example embodiments, the system 100 could include a controller 150. The controller 150 could include a computer, or another type of microcontroller configured to execute instructions so as to carry out various operations. For example, the controller 150 may include one or more processors 152 and at least one memory 154. The processor (s) may include, for instance, a microprocessor, an application-specific integrated circuit (ASIC), or a field-programmable gate array (FPGA). Other types of processors, circuits, computers, or electronic devices configured to carry out software instructions are contemplated herein.

The memory may include a non-transitory computer-readable medium, such as, but not limited to, read-only memory (ROM), programmable read-only memory (PROM), erasable programmable read-only memory (EPROM), electrically erasable programmable read-only memory (EEPROM), non-volatile random-access memory (e.g., flash memory), a solid state drive (SSD), a hard disk drive (HDD), a Compact Disc (CD), a Digital Video Disk (DVD), a digital tape, read/write (R/W) CDs, R/W DVDs, etc.

The one or more processors of controller 150 may be configured to execute instructions stored in the memory so as to carry out various operations and method steps/blocks described herein. The instructions may be stored in a permanent or transitory manner in the memory.

In some examples, the operations carried out by the controller 150 may include causing the flip door actuation mechanism 144 to controllably move the flip door portion 120 between the raised configuration and the platform configuration.

In some embodiments, the operations may additionally include causing the guardrail portion 130 to controllably move between a retracted guardrail configuration and an extended guardrail configuration.

Such operations could be beneficial because the controller-based operations could take the place of, supplement, or make safer manual tasks during aircraft assembly line pulsing activities. Namely, instead of using personnel to manually replace guardrails, the flip door portion 120 could be automatically or semi-automatically adjusted between the raised configuration and the platform configuration. Additionally or alternatively, the systems and methods described herein may provide that the guardrail portion 130 could be automatically or semi-automatically adjusted between a retracted guardrail configuration and an extended guardrail configuration. Such controller-based (e.g., automated or semi-automated) operations could prevent injuries to worker personnel, such as repetitive-use injuries and falls.

In various embodiments, the system 100 includes a remote unit 170. The remote unit 170 could be configured to control one or more configurations of the system 100. The remote unit 170 may include a wired remote controller having a user interface 172. In such scenarios, the user interface 172 at least one button 174. Other types of remote units are possible and contemplated.

In some embodiments, a user could press the at least one button 174 to provide a command to extend or retract the system 100 between the raised configuration and the platform configuration. For instance, the remote unit 170 could include a "RAISE" button and a "LOWER" button. User interactions with such buttons could provide corresponding commands to the flip door actuation mechanism 144 and/or controller 150 to adjust a position of the flip door portion 120 and/or the guardrail portion 130.

Figure 2A:
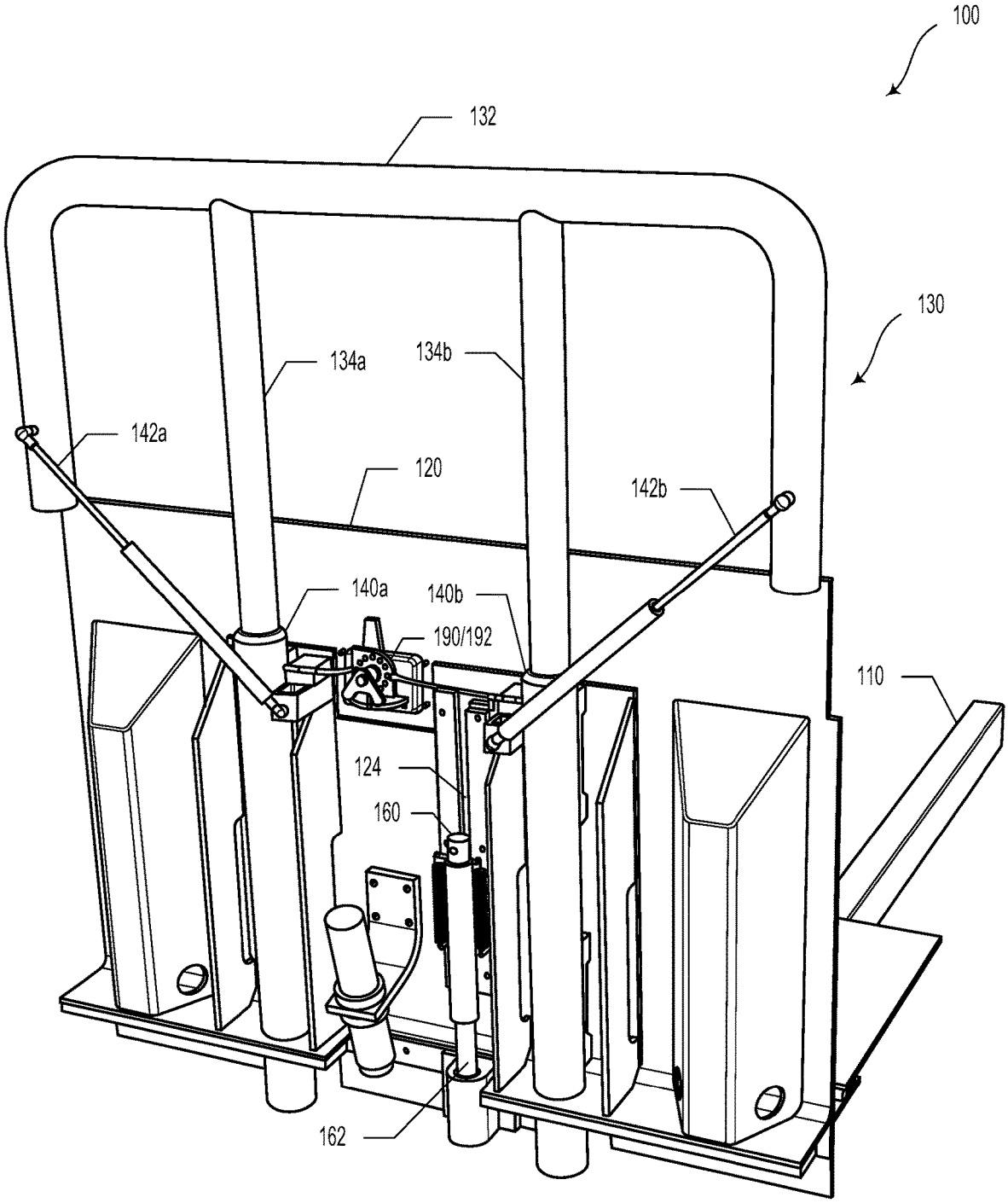
FIG. 2A illustrates the system of FIG. 1, according to an example implementation.

FIG. 2A illustrates the system 100 of FIG. 1, according to an example implementation. As illustrated in FIG. 2A, system 100 may include a raised flip door portion 120 that is arranged substantially perpendicular to a walking surface (e.g., walking surface 12) and/or a reference plane (e.g., reference plane 14). Additionally, as illustrated in FIG. 2A, the guardrail portion 130, particularly the top rail 132 could be extended away from the flip door portion 120 and the corresponding walking surface and/or reference plane. In such a configuration (e.g., RAISED FLIP DOOR WITH EXTENDED GUARDRAIL CONFIGURATION), the system 100 may provide protection from falls and/or prevent access to unauthorized areas by providing a physical barrier and guardrail.

Figure 2B:
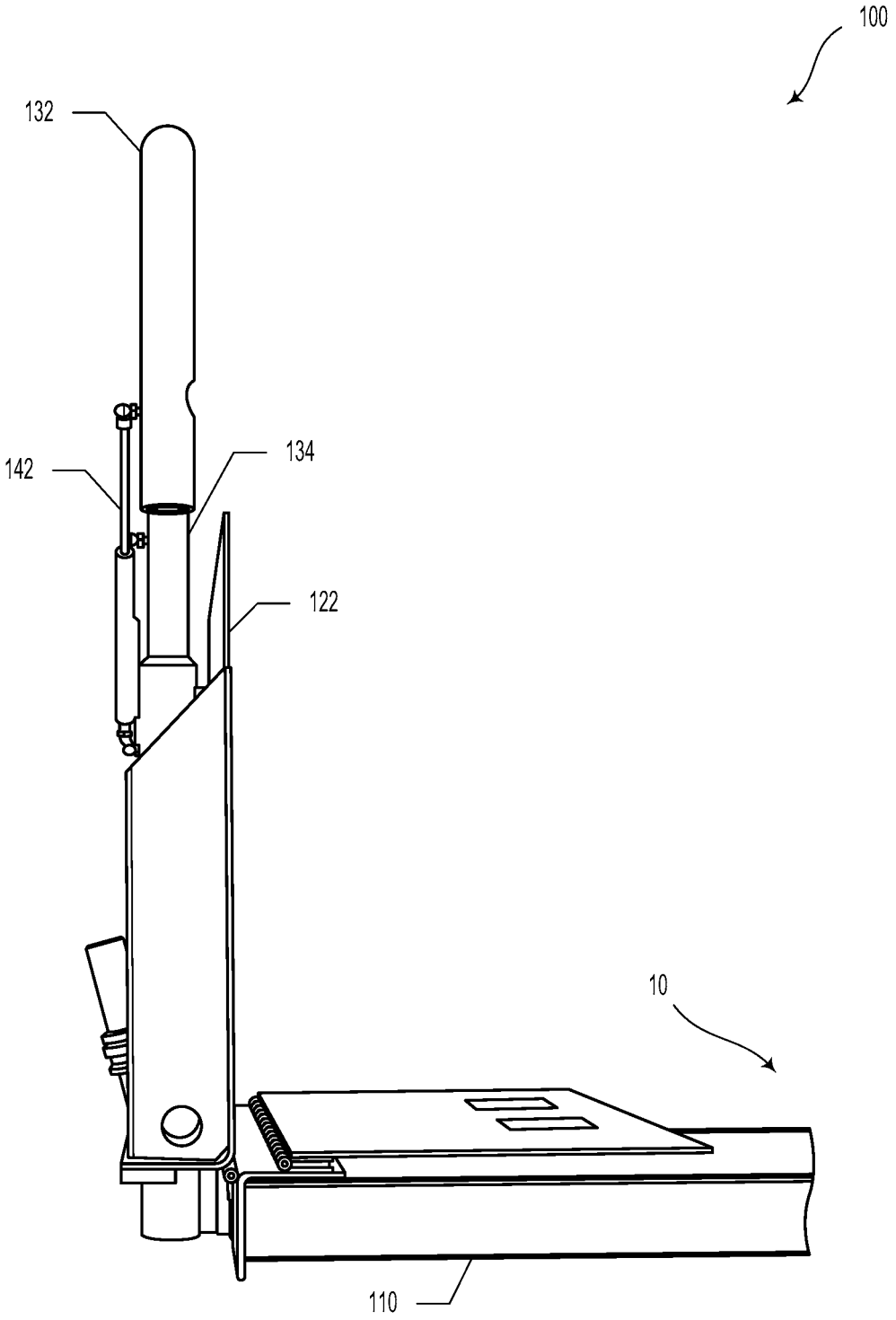
FIG. 2B illustrates the system of FIG. 1, according to an example implementation.

FIG. 2B illustrates the system 100 of FIG. 1, according to an example implementation. FIG. 2B provides an alternate view of the configuration illustrated and described with reference to FIG. 2A.

Figure 2C:
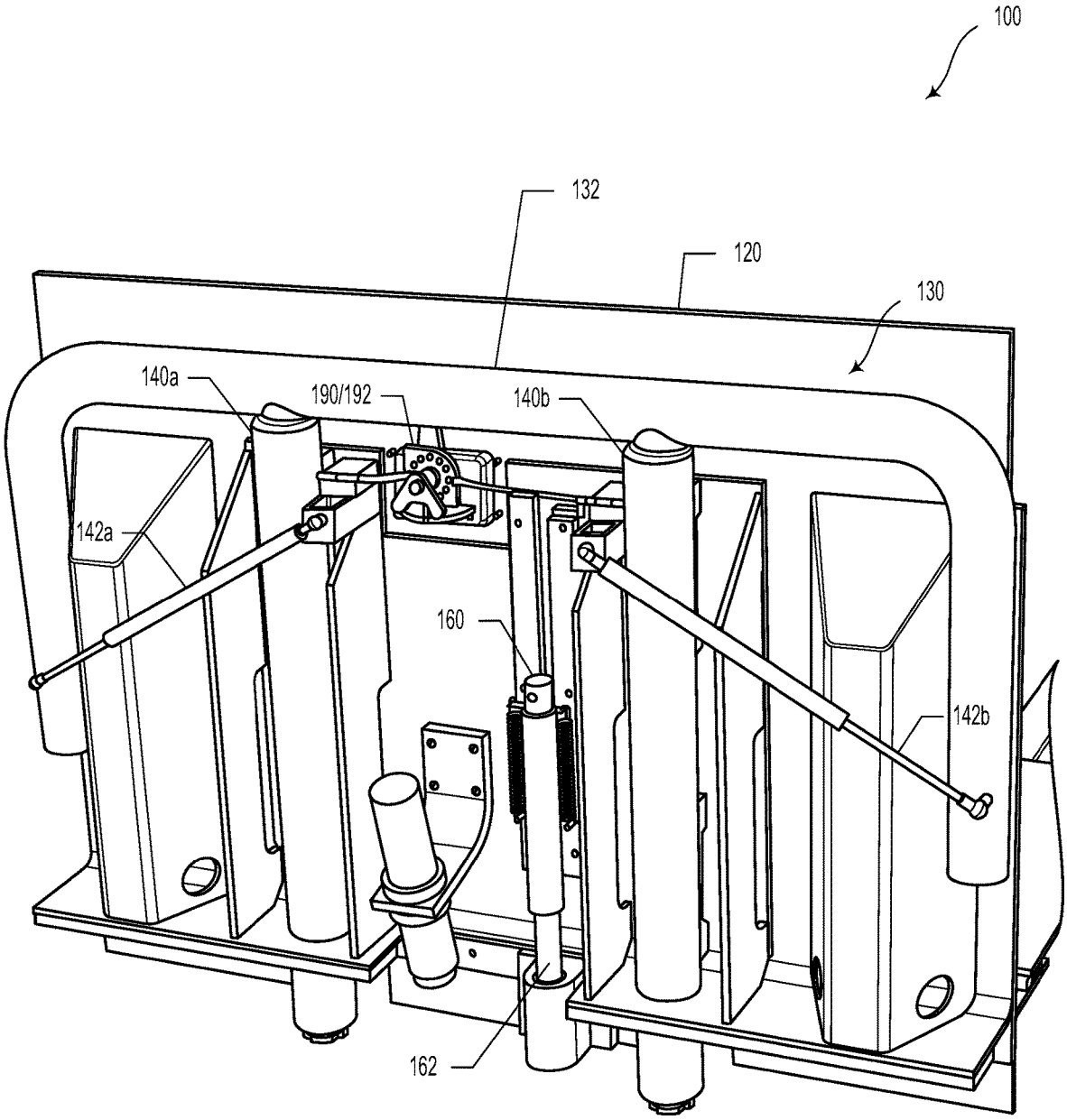
FIG. 2C illustrates the system of FIG. 1, according to an example implementation.

FIG. 2C illustrates the system 100 of FIG. 1, according to an example implementation. As illustrated in FIG. 2C, the system 100 could be arranged in a configuration that includes the flip door portion 120 being raised (e.g., substantially perpendicular) with respect to the walking surface and/or reference plane. Furthermore, in some embodiments, the guardrail portion 130 may be retracted (e.g., unextended) with respect to the flip door portion 120. In such a configuration (e.g., RAISED FLIP DOOR WITH RETRACTED GUARDRAIL CONFIGURATION), the system 100 may be in an intermediate position provided between the configuration illustrated in FIG. 2A and the configuration illustrated in FIG. 2D.

Figure 2D:
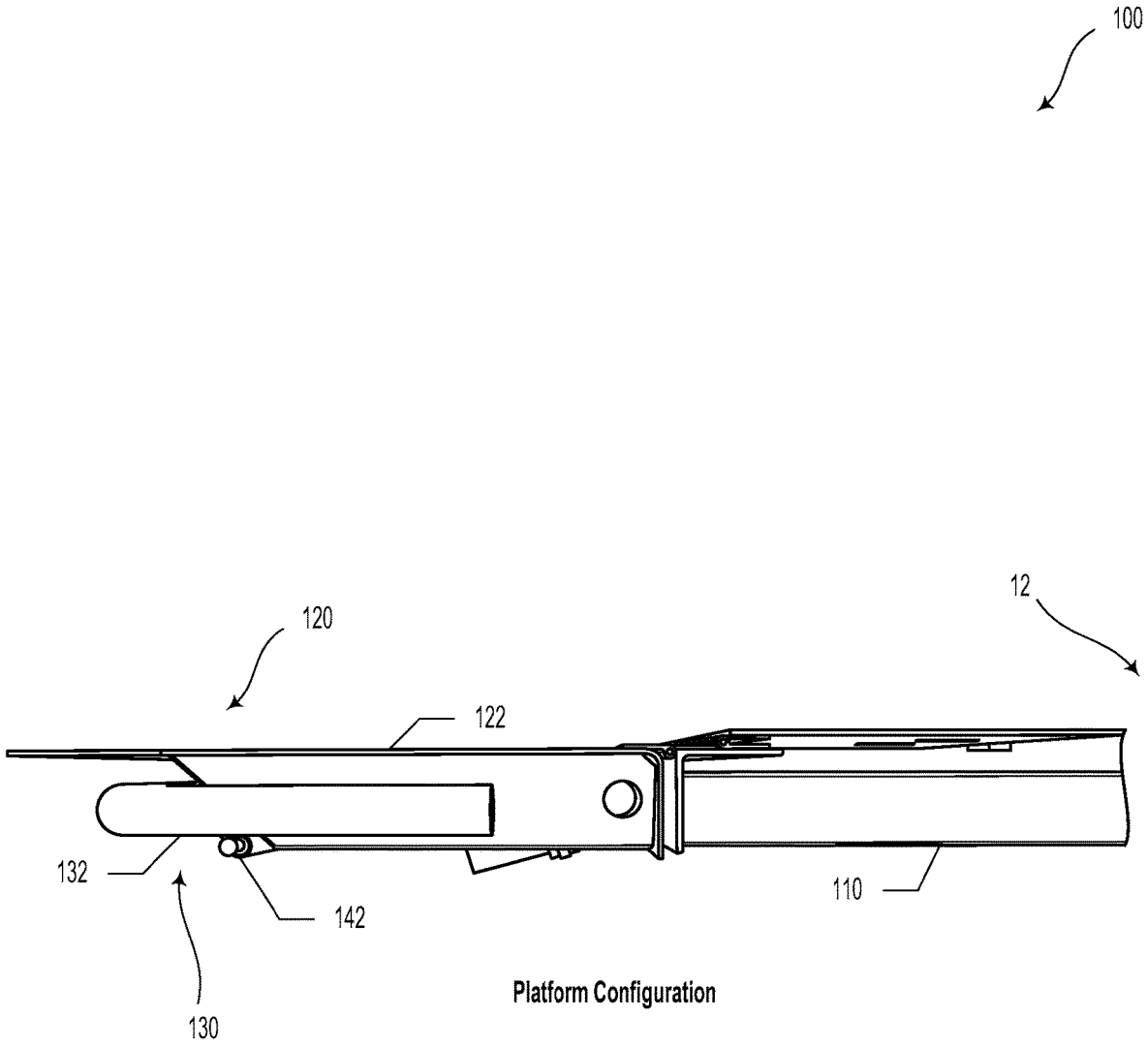
FIG. 2D illustrates the system of FIG. 1, according to an example implementation.

FIG. 2D illustrates the system 100 of FIG. 1, according to an example implementation. As illustrated in FIG. 2D, the system 100 may be arranged in a PLATFORM CONFIGURATION, which could include the flip door portion 120 arranged as being substantially parallel to the walking surface 12 and/or the corresponding reference plane 14. In such a manner, the system 100 may provide a standing platform and/or walkway for users (e.g., maintenance personnel) while working. In such a configuration, the guardrail portion 130 would generally be retracted so as to prevent "mark off" or other types of damage to an airplane structure (e.g., aircraft bulkhead or wing, etc.).

Figure 3A:
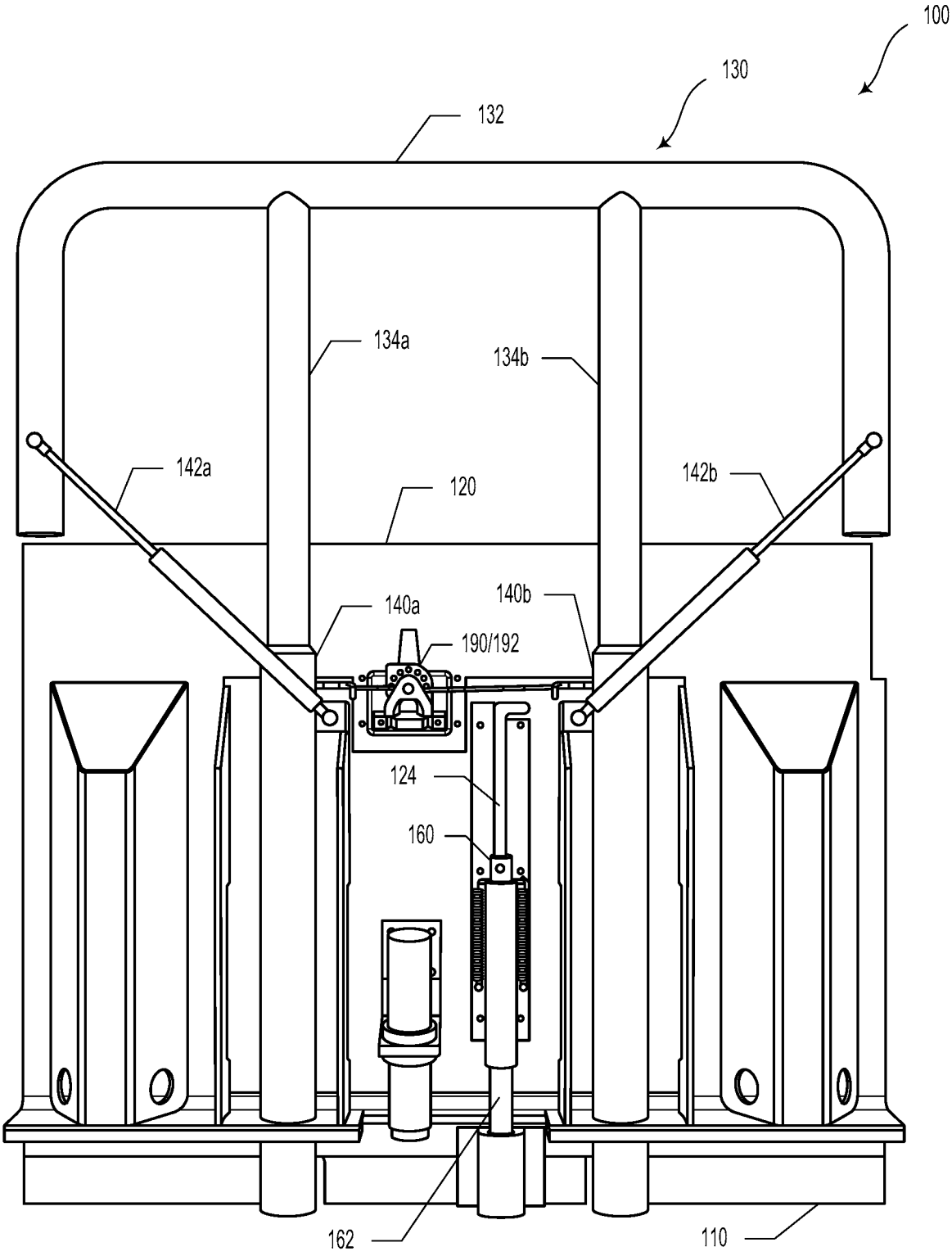
FIG. 3A illustrates the system of FIG. 1, according to an example implementation.

FIG. 3A illustrates the system 100 of FIG. 1, according to an example implementation. FIG. 3A provides an alternate view of the system 100 while in the RAISED FLIP DOOR WITH EXTENDED GUARDRAIL CONFIGURATION.

Figure 3B:
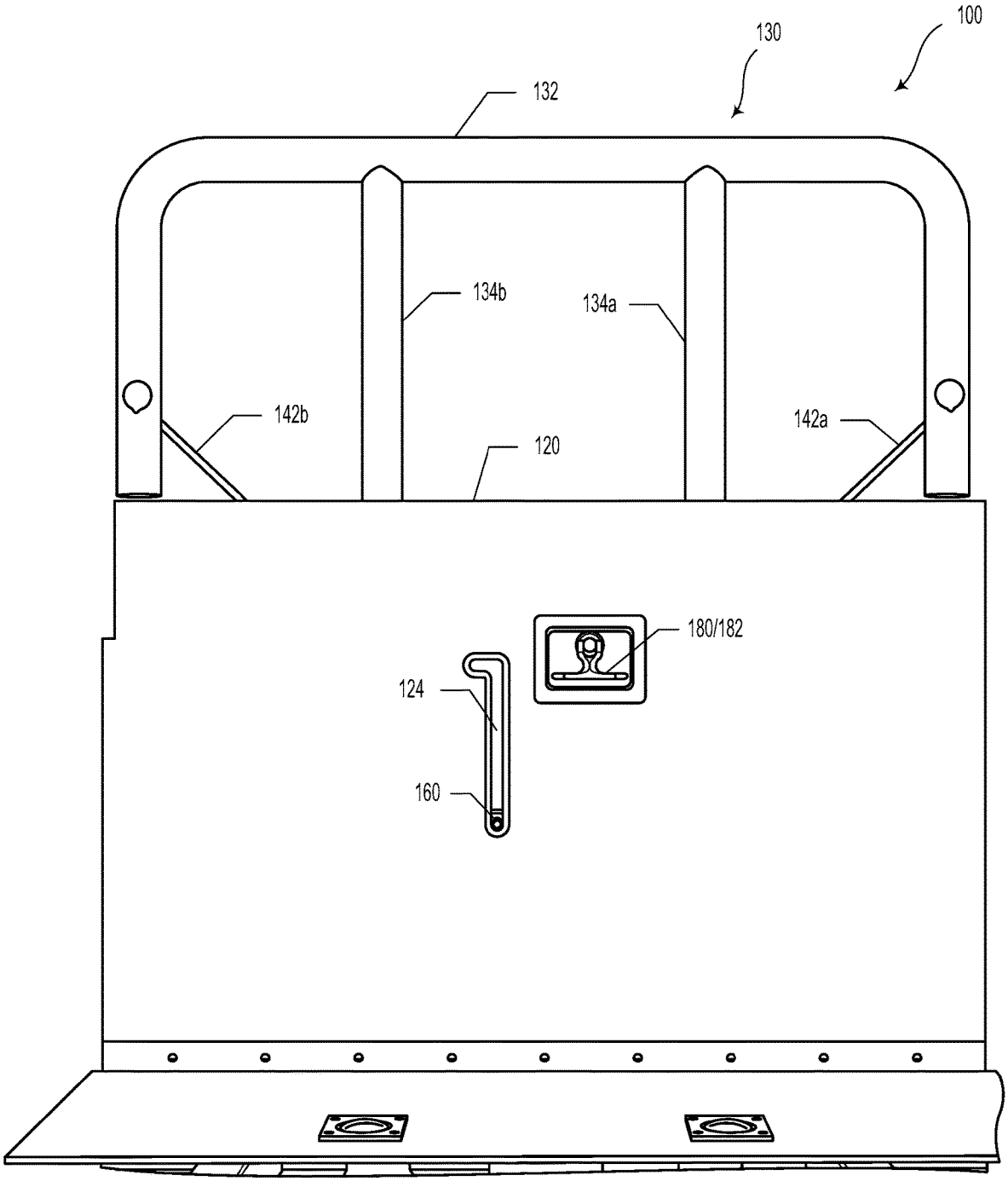
FIG. 3B illustrates the system of FIG. 1, according to an example implementation.

FIG. 3B illustrates the system 100 of FIG. 1, according to an example implementation. FIG. 3B provides an alternate view of the system 100 while in the RAISED FLIP DOOR WITH EXTENDED GUARDRAIL CONFIGURATION. In particular, FIG. 3B illustrates the groove opening 124 in the top surface 122 of the flip door portion 120. Furthermore, FIG. 3B illustrates a portion of the locking mechanism 160 that is accessible by way of the groove opening 124. In some examples, the locking mechanism 160 could include a pin or bar that can be manually manipulated from a first position along the groove opening 124 to a second position along the groove opening 124 so as to lock and/or unlock the locking mechanism 160. Additionally, FIG. 3B illustrates a portion of the guardrail release mechanism 180, which could include a guardrail release handle 182 that is accessible from the top surface 122 of the flip door portion 120.

Figure 4A:
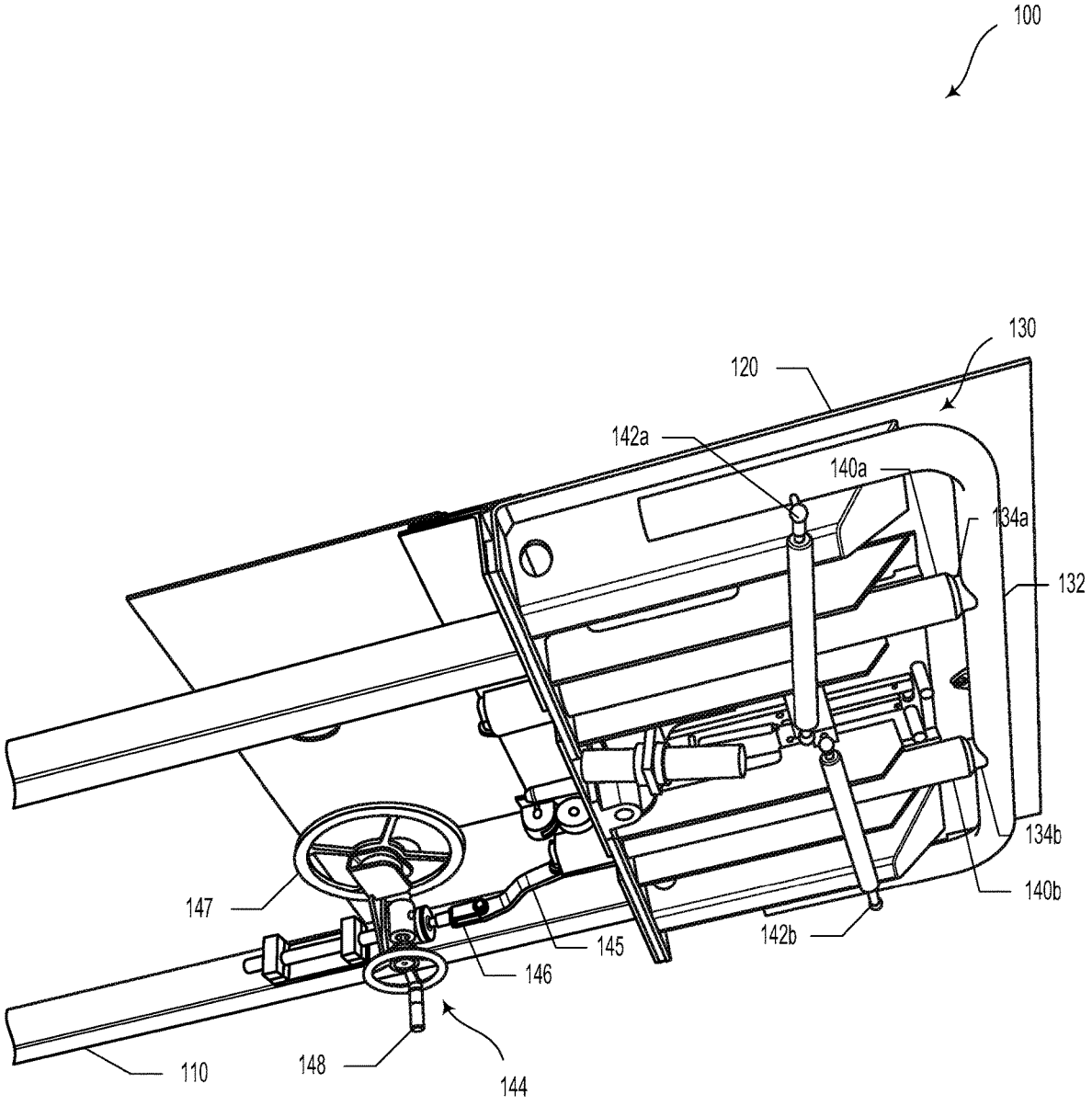
FIG. 4A illustrates the system of FIG. 1, according to an example implementation.

FIG. 4A illustrates the system 100 of FIG. 1, according to an example implementation. As illustrated in FIG. 4A, the system 100 could be in the PLATFORM CONFIGURATION. Furthermore, in some embodiments, system 100 may include a flip door actuation mechanism 144. The flip door actuation mechanism 144 could include, for example, gearing 147, a hand crank 148, a push rod 146, and/or a link arm 145. It will be understood that other ways to mechanically actuate the flip door portion 120 are contemplated and possible within the context of the current disclosure.

Figure 4B:
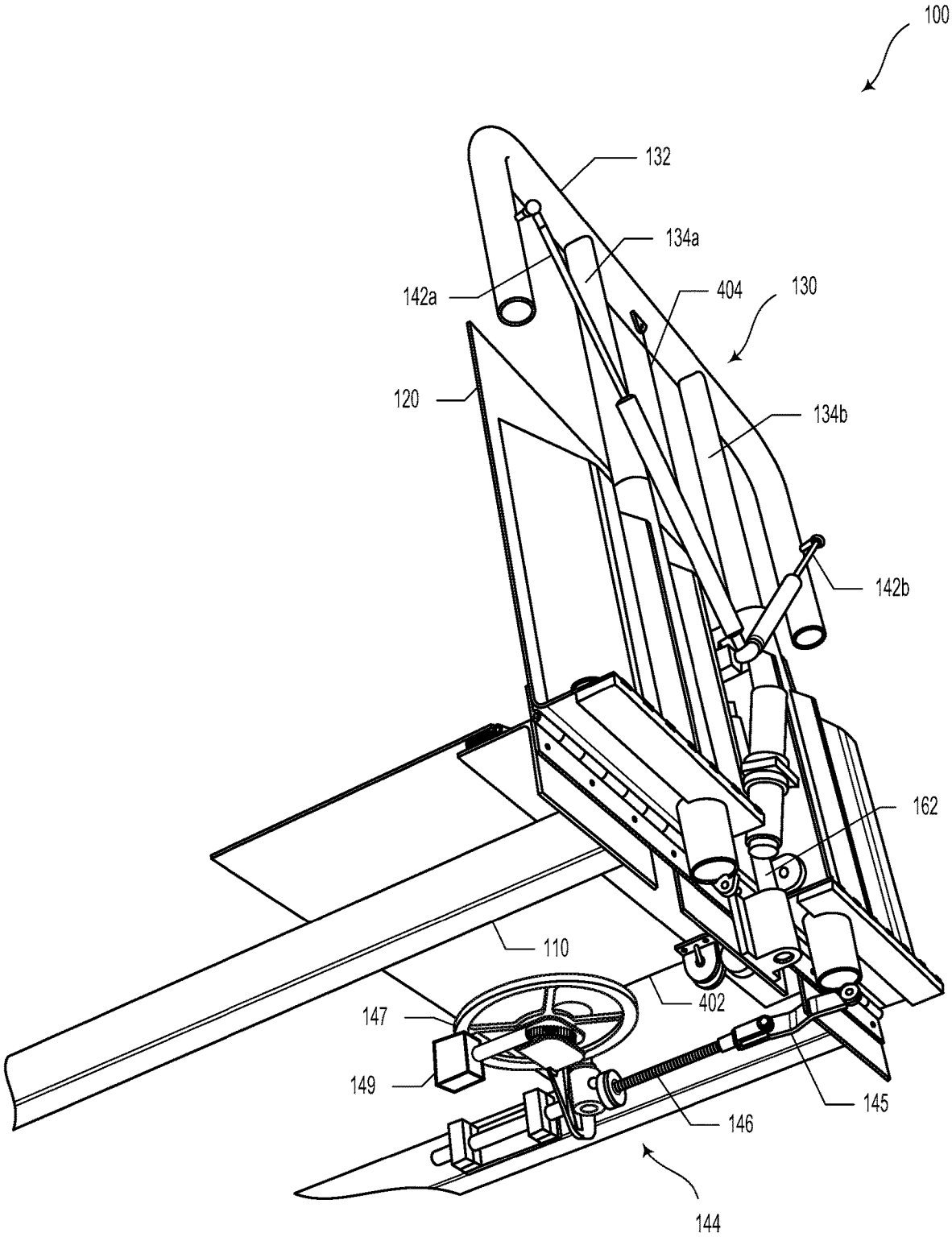
FIG. 4B illustrates the system of FIG. 1, according to an example implementation.

FIG. 4B illustrates the system 100 of FIG. 1, according to an example implementation. FIG. 4B may illustrate the system 100 as being in the RAISED FLIP DOOR WITH EXTENDED GUARDRAIL CONFIGURATION. As illustrated in FIG. 4B, the flip door actuation mechanism 144 could include an electric motor 149 configured to drive the gearing 147, push rod 146 and/or the link arm 145. In some embodiments, the electric motor 149 could be controlled by controller 150 and/or the remote unit 170. That is, the controller 150 and/or the remote unit 170 could provide instructions (e.g., electrical signals) to the electric motor 149 to rotate a jack screw (e.g., push rod 146) so as to actuate the link arm 145 so as to raise or lower the flip door portion 120. Furthermore, the gearing 147 could be attached to one or more cables (e.g., cable 402 and/or cable 404) so as to extend or retract the top rail 132 of the guardrail portion 130. It will be understood that other mechanical configurations to raise or lower the flip door portion 120 and extend or retract the top rail 132 are possible. All such other mechanical configurations are contemplated within the context of the present disclosure.

Figure 4C:
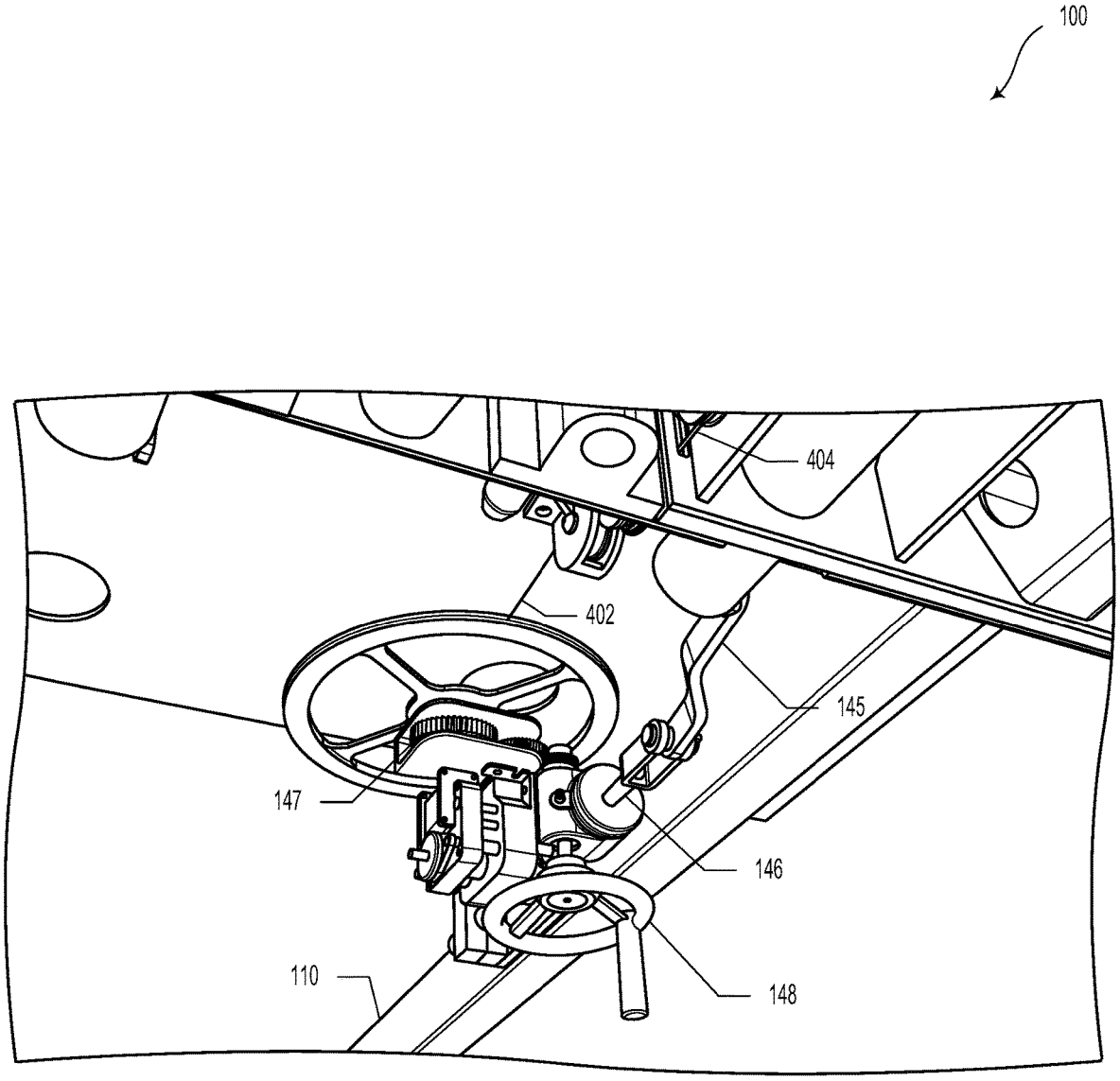
FIG. 4C illustrates the system of FIG. 1, according to an example implementation.

FIG. 4C illustrates the system 100 of FIG. 1, according to an example implementation. FIG. 4C is a close up view of the underside of system 100. In particular, in the illustrated embodiment, the hand crank 148 could be operable to i) raise or lower the flip door portion 120 by way of push rod 146 and link arm 145 and; ii) extend or retract the top rail 132 by way of cable 402 and/or cable 404.

III. Example Deck Platforms

Figure 5:
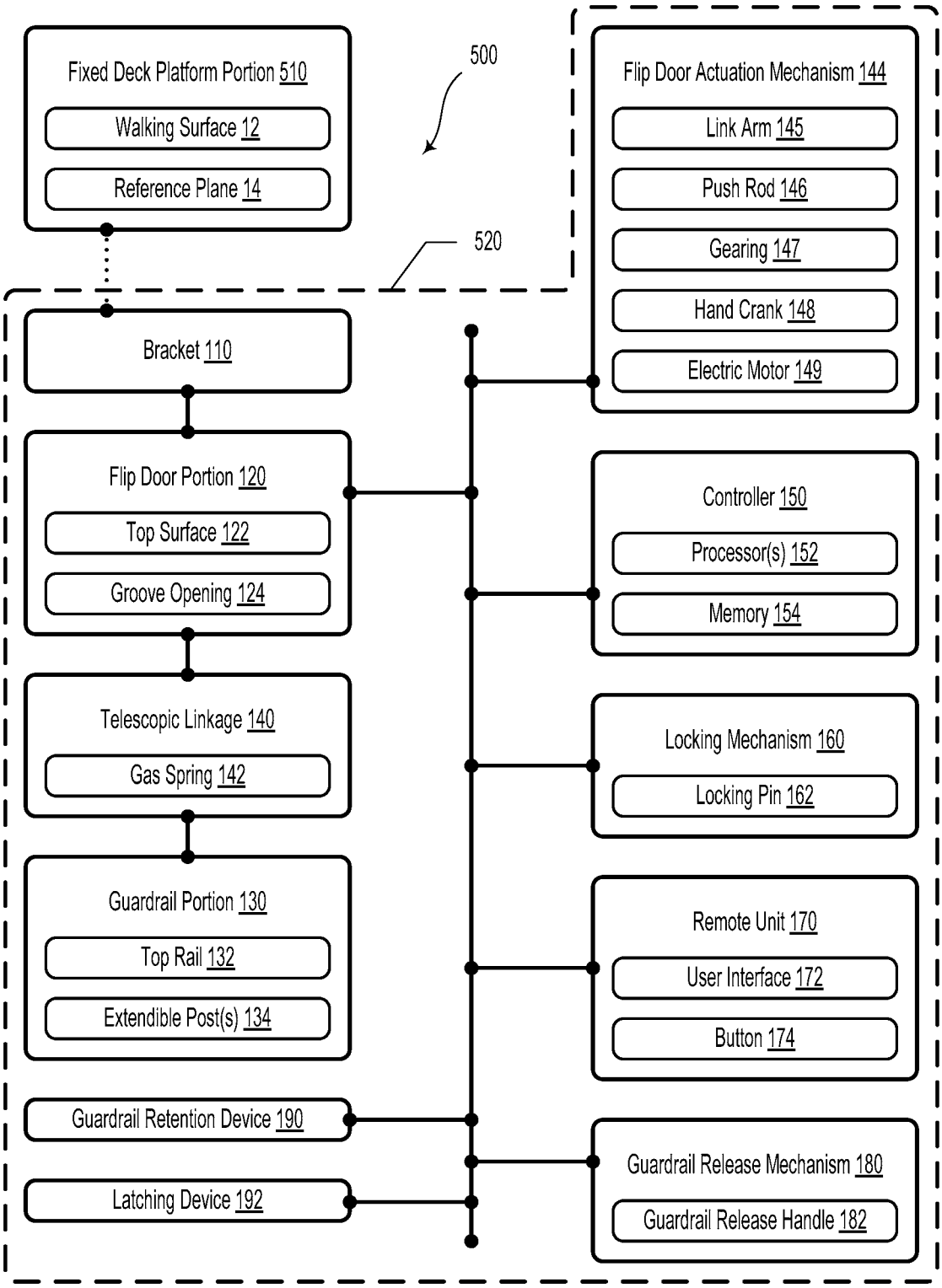
FIG. 5 illustrates a deck platform, according to an example implementation.

FIG. 5 illustrates a deck platform 500, according to an example implementation. The deck platform 500 could include a fixed deck platform portion 510 that includes a walking surface 12. The deck platform 500 also includes a movable deck platform portion 520. In some embodiments, the movable deck platform portion 520 could be similar or identical to system 100, as illustrated and described in reference to FIGS. 1, 2A-D, 3A-B, and 4A-C.

In some embodiments, the movable deck platform portion 520 could be operable to rotate or fold with respect to the fixed deck platform portion 510 so as to provide clearance for an aircraft to move along an aircraft assembly line. Other types of deck platforms are possible and contemplated herein.

While "pulsing" the aircraft assembly line, the movable deck platform portion 520 could rotate to a substantially vertical position to provide a protective barrier for personnel with the extended guardrails while rotating the movable deck platform portion up and away from the aircraft fuselage. Once an aircraft is in proper position for work to commence, the movable deck platform portion 520 may be rotated into a substantially horizontal position, and the guardrail portion 130 described herein could retract substantially under a top surface 122 of the flip door portion 120.

In some embodiments, the movable deck platform portion 520 could include a bracket 110 configured to be coupled to the fixed deck platform portion 510 and a flip door portion 120 rotatably coupled to the bracket 110. The movable deck platform portion 520 also includes a guardrail portion 130 extendibly coupled to the flip door portion 120.

In various examples, the movable deck platform portion 520 additionally includes a telescopic linkage 140. In some embodiments, the telescopic linkage 140 further couples the flip door portion 120 to the guardrail portion 130.

In some embodiments, the movable deck platform portion 520 also includes a locking mechanism 160 with a locking pin 162. In such scenarios, the locking pin 162 is configured to maintain the flip door portion 120 in a raised configuration. In such scenarios, the movable deck platform portion 520 is configured to be adjusted between the raised configuration and a platform configuration.

In some embodiments, the walking surface 12 could define a reference plane 14. In such scenarios, the raised configuration includes the flip door portion 120 disposed substantially perpendicular to the reference plane 14 and the guardrail portion 130 being extended away from the flip door portion 120. In some scenarios, the platform configuration comprises the flip door portion 120 extending substantially parallel along the reference plane 14 and the guardrail portion 130 being stowed under a top surface 122 of the flip door portion 120.

IV. Example Methods

Figure 6:
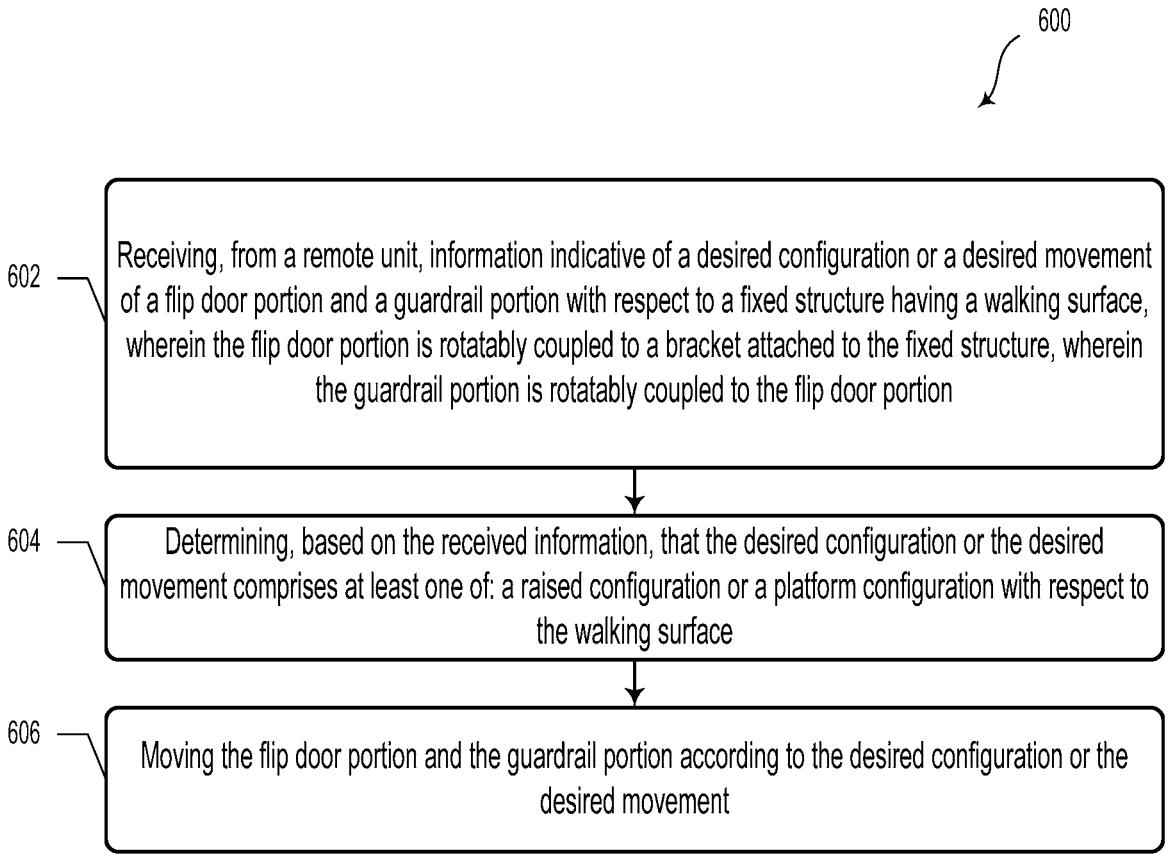
FIG. 6 illustrates a method, according to an example implementation.
Figure 7A:
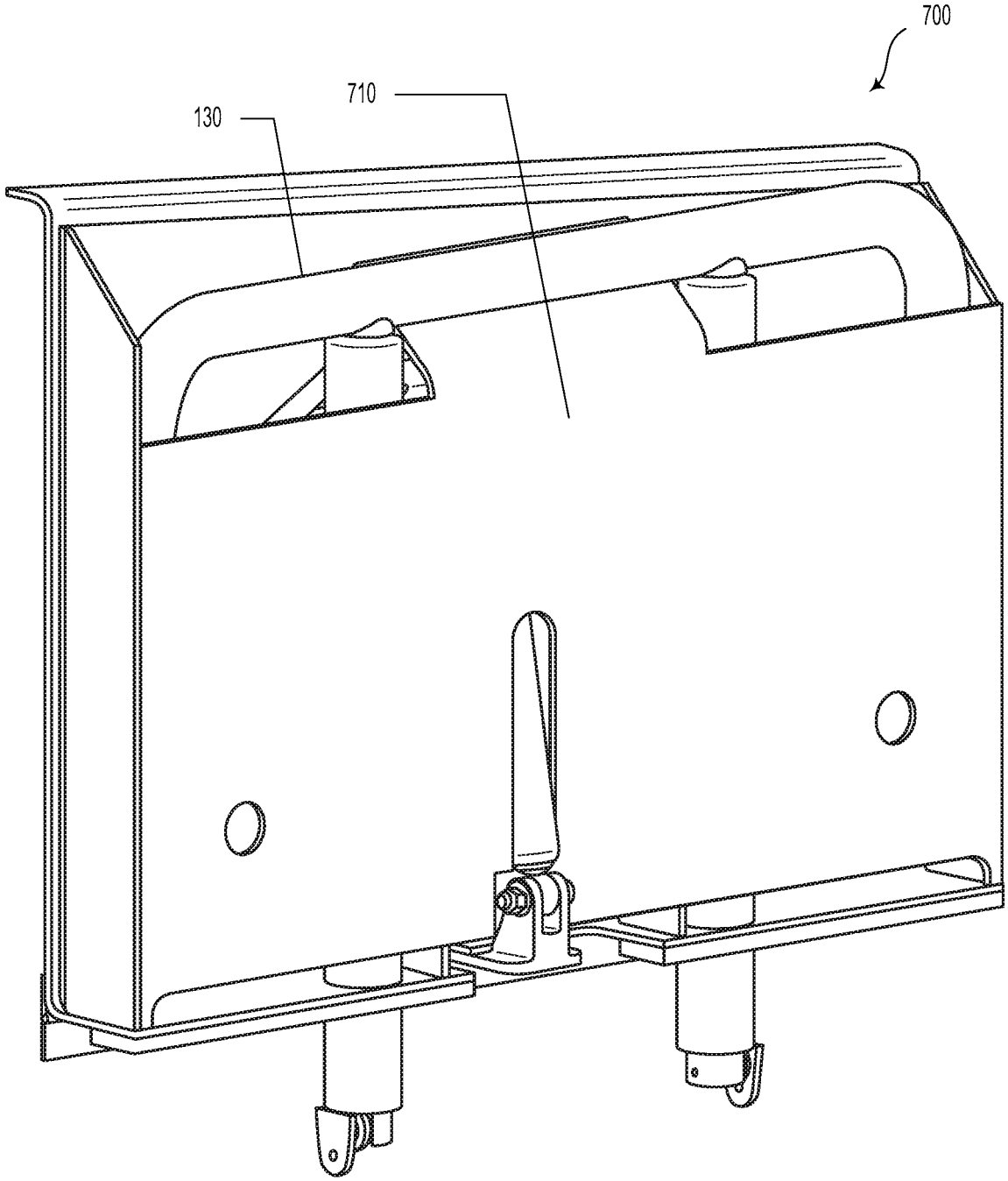
FIG. 7A illustrates a deck platform, according to an example implementation.
Figure 7B:
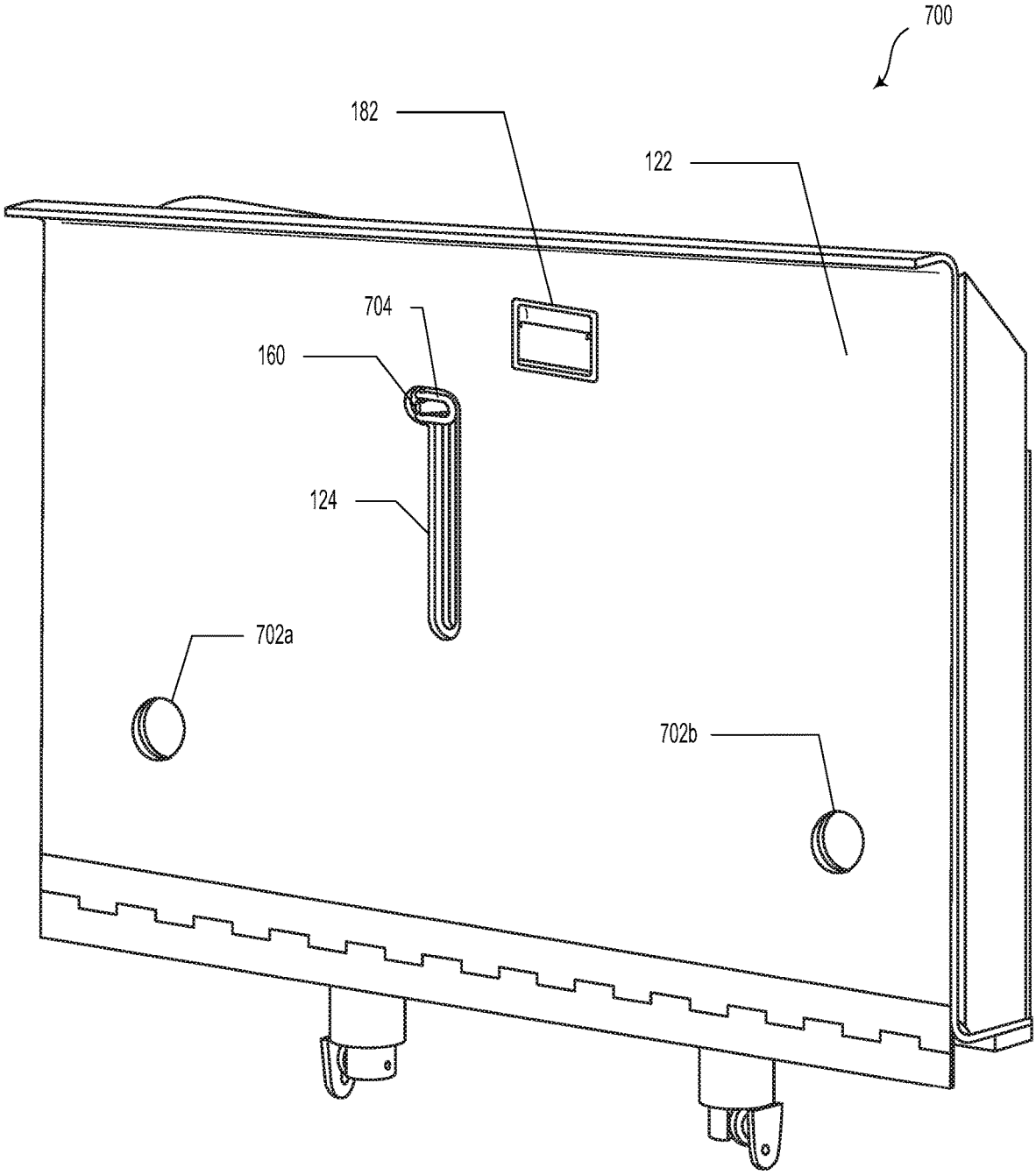
FIG. 7B illustrates a deck platform, according to an example implementation.
Figure 7C:
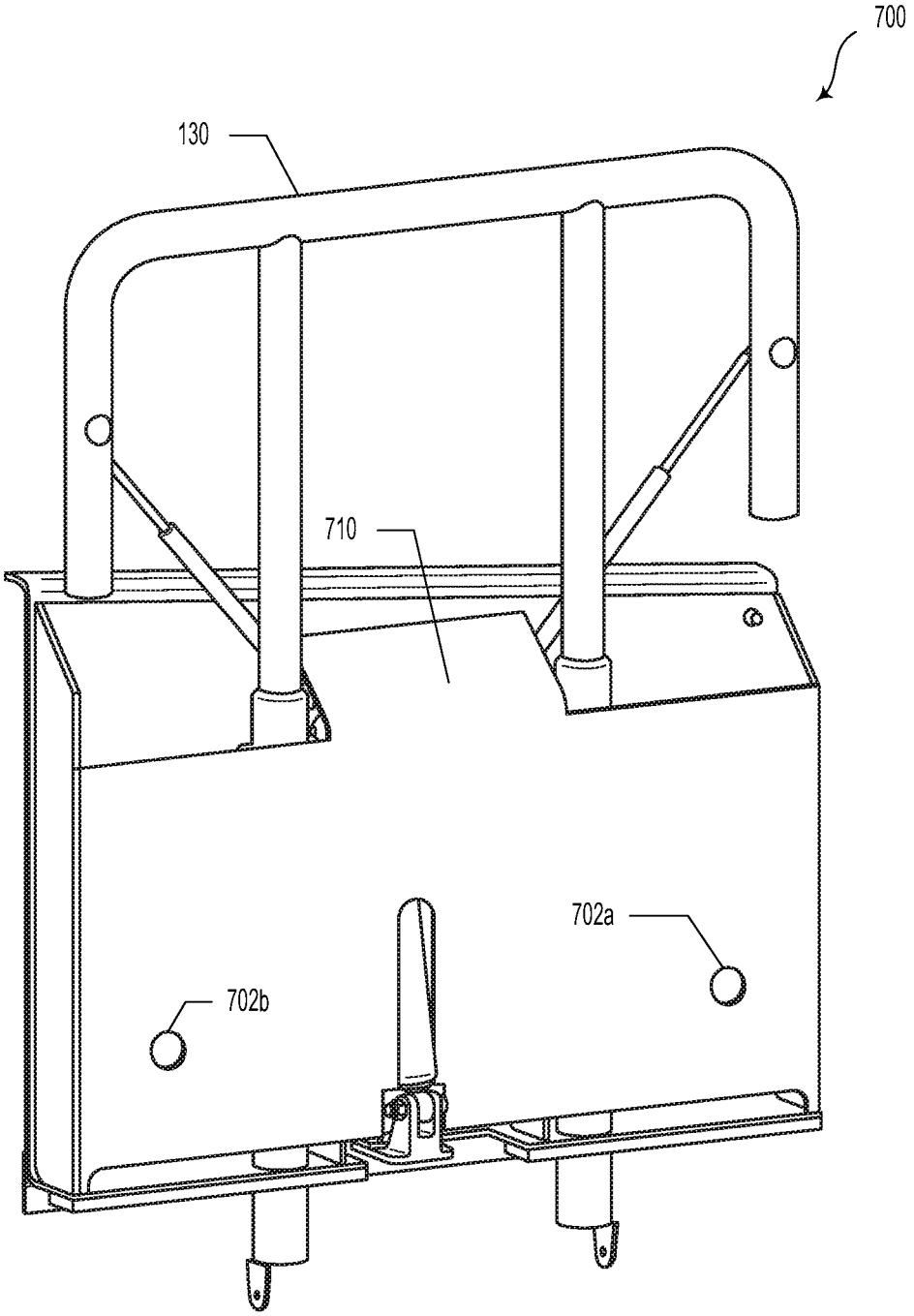
FIG. 7C illustrates a deck platform, according to an example implementation.
Figure 7D:
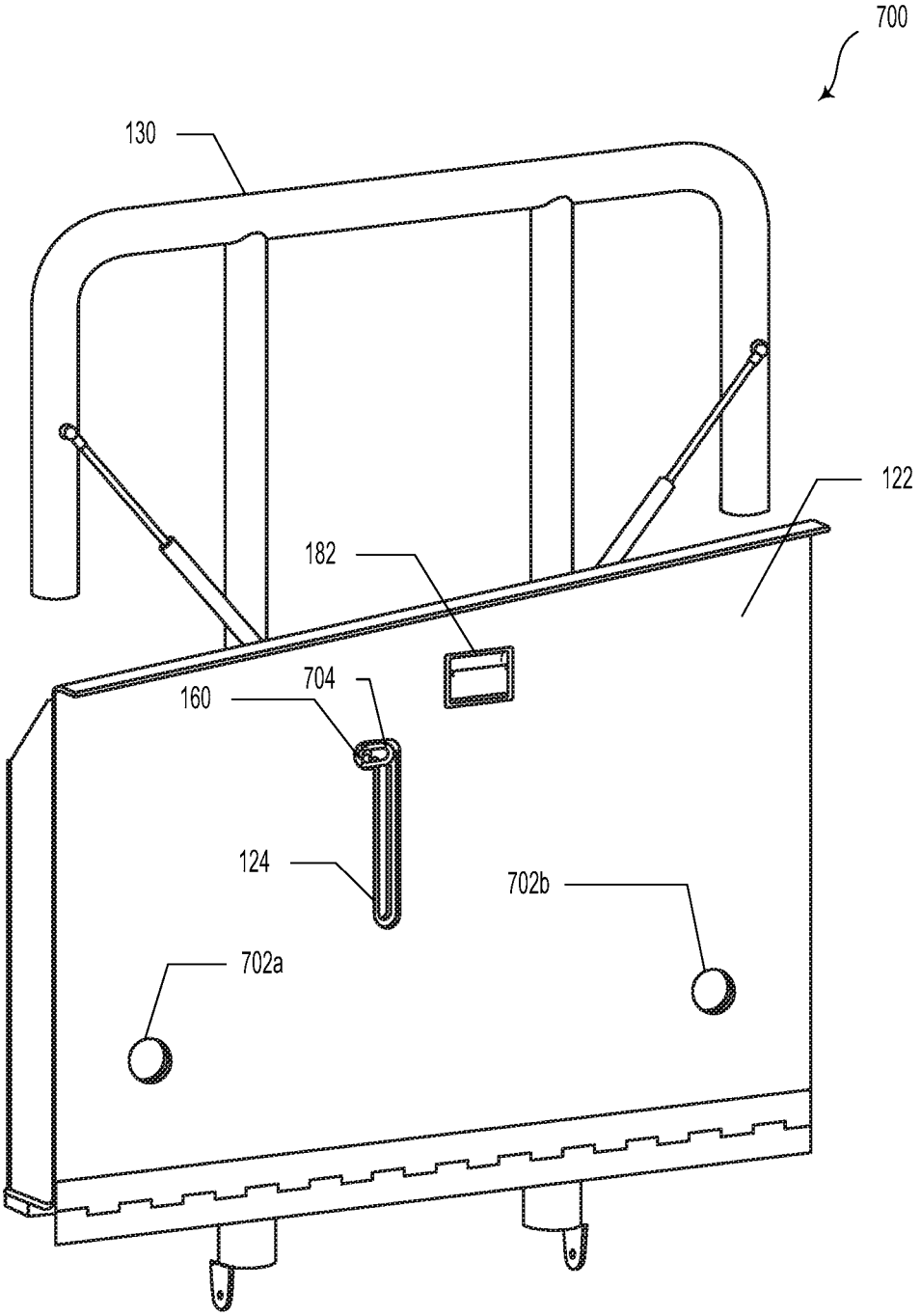
FIG. 7D illustrates a deck platform, according to an example implementation.
Figure 7E:
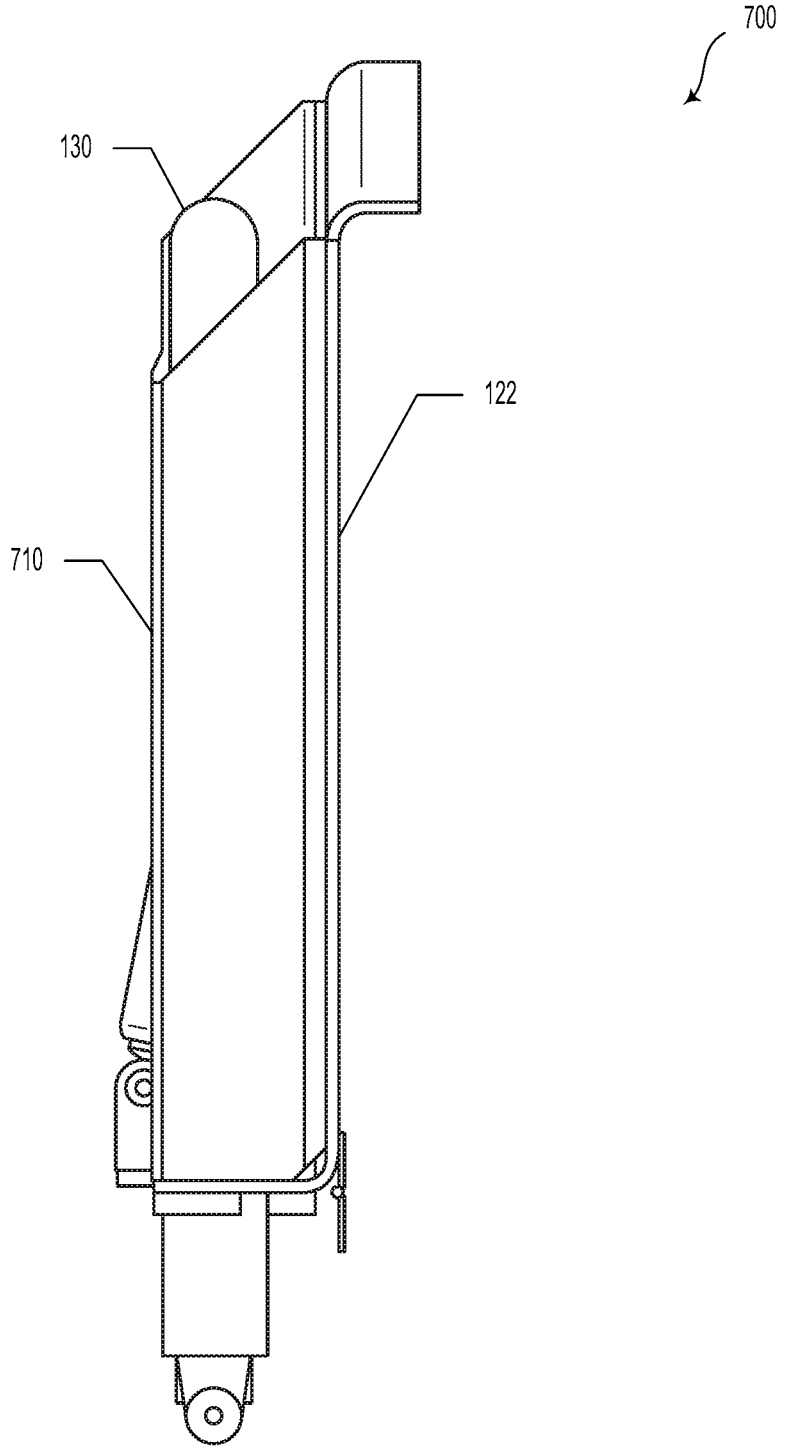
FIG. 7E illustrates a deck platform, according to an example implementation.
Figure 7F:
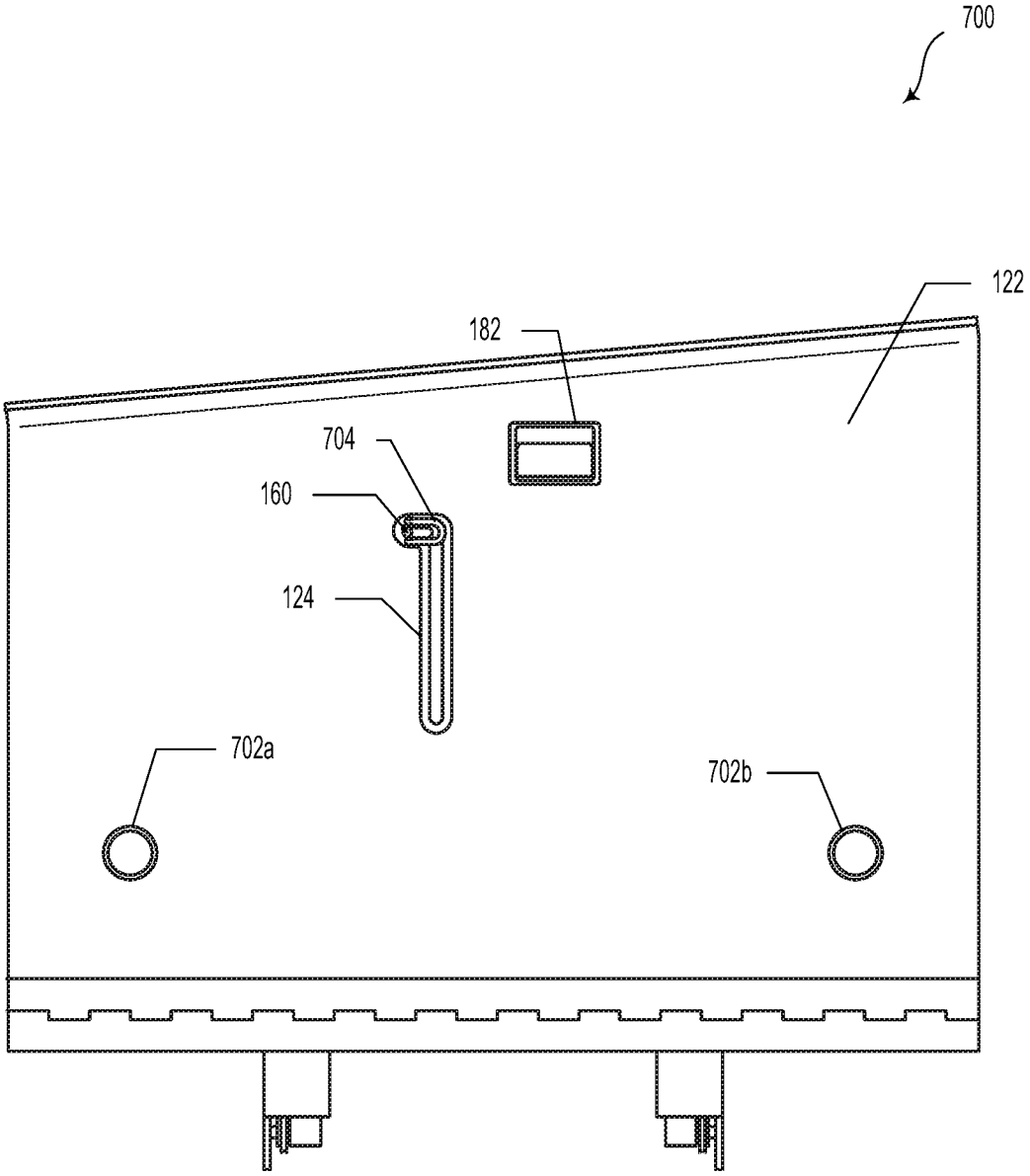
FIG. 7F illustrates a deck platform, according to an example implementation.

FIG. 6 illustrates a method 600, according to an example implementation. Method 600 may involve elements of system 100 and/or deck platforms 500 as illustrated and described in reference to FIGS. 1 and 5. While FIG. 6 illustrates certain blocks or steps of method 600 as following a specific order, it will be understood that some blocks or steps could be omitted and/or other blocks or steps could be included. Furthermore, the blocks or steps could be carried out in a different order, in parallel (e.g., concurrently), and/or repeated. In some embodiments, at least some blocks of method 600 could be carried out, at least in part, by controller 150, as illustrated and described in reference to FIG. 1.

Block 602 includes receiving, from a remote unit (e.g., remote unit 170), information indicative of a desired configuration or a desired movement of a flip door portion (e.g., flip door portion 120) and a guardrail portion (e.g., guardrail portion 130) with respect to a fixed structure 10 having a walking surface 12. The flip door portion is rotatably coupled to a bracket (e.g., bracket 110) attached to the fixed structure 10. The guardrail portion is rotatably coupled to the flip door portion.

For example, a user could push a button (e.g., button 174) on the remote unit corresponding to a desired configuration or desired movement of the flip door portion and guardrail portion. Alternatively, the user could interact with a user interface (e.g., user interface 172) of the remote unit to indicate the desired configuration or desired movement.

Block 604 includes determining, based on the received information, that the desired configuration or the desired movement comprises at least one of a raised configuration or a platform configuration with respect to the walking surface. Determining the desired configuration or desired movement could include comparing the received information to a look up table and/or carrying out instructions otherwise associated with the received information.

Block 606 includes moving the flip door portion and the guardrail portion according to the desired configuration or the desired movement. As described herein, moving the flip door portion and/or the guardrail portion could be controlled by a controller (e.g., controller 150). Furthermore, the controller could provide instructions and/or control signals to a flip door actuation mechanism (e.g., flip door actuation mechanism 144) so as to mechanically move the flip door portion and/or the guardrail portion. In other embodiments, the flip door portion and/or the guardrail portion could be moved manually.

In some embodiments, method 600 may additionally or alternatively include, in response to determining that the desired movement comprises the raised configuration: rotating the flip door portion upward with respect to the walking surface of the fixed structure, releasing a guardrail release mechanism (e.g., guardrail release mechanism 180), and extending the guardrail portion with respect to the flip door portion.

Additionally or alternatively, method 600 may include, in response to determining the desired movement comprises the platform configuration: retracting the guardrail portion with respect to the flip door portion, engaging a guardrail retention device, rotating the flip door portion downward with respect to the walking surface of the fixed structure. It will be understood that other physical adjustments of the various elements of the system and/or deck platform are possible within the context of the present disclosure so as to perform the desired movement and/or achieve the desired configuration.

The information about the desired configuration or the desired movement could include a signal from a user interaction, which could include a user pushing a button, touching a touchscreen, moving a switch, a voice command, etc. For example, the remote unit could include two buttons—a first button to lower the flip door portion (and retract the guardrail portion) and a second button to raise the flip door portion (and extend the guardrail portion). In response to a user pushing the button to lower the flip door portion, the remote unit may transmit the desired movement (lower the flip door portion) to an actuator controller or another type of control system. Similarly, in response to a user pushing the button to raise the flip door portion, the remote unit may transmit the desired movement (raise the flip door portion) to an actuator controller or another type of control system. In some examples, the signal to raise or lower the flip door portion may be transmitted while the user is pushing the corresponding button on the remote unit. For instance, a user may be able to control an amount of movement of the flip door portion by releasing a button once the flip door portion has reached a desired configuration (e.g., an intermediate configuration, etc.).

In other examples, the received information could include a desired configuration (e.g., fully raised flip door portion or fully lowered flip door portion). In such scenarios, a user need only push the corresponding button (or touchscreen icon) once to provide a signal relating to the desired configuration.

The information about the desired configuration or the desired movement could also include a signal from a computing system. For example, the signal could include an automated raise command or an automated lower command. Additionally or alternatively, the information about the desired configuration or the desired movement could be provided according to a predetermined schedule and/or based on a planned movement of an aircraft, personnel shift change, among other possibilities.

V. Additional Example Embodiments

FIGS. 7A-7F illustrate various views of a deck platform 700, according to an example implementation. Deck platform 700 could be similar or identical to system 100 and/or deck platform 500 as illustrated and described in reference to FIGS. 1, 2A-D, 3A-B, 4A-C, and 5. In some embodiments, deck platform 700 may include a back plate 710. The back plate 710 could cover and/or physically protect other portions of the deck platform 700, such as the moving mechanisms configured to move the flip door portion (e.g., flip door portion 120, locking mechanism 160, guardrail release mechanism 180, and flip door actuation mechanism 144), telescopic linkage (e.g., telescopic linkage 140) and/or the guardrail portion (e.g., guardrail portion 130).

In some embodiments, deck platform 700 could include one or more stake pockets 702*a*, 702*b*. The stake pockets 702*a*, 702*b* could include openings in the deck platform 700 that may pass through a walking/deck surface (e.g., top surface 122). In some embodiments, the stake pockets 702*a* and 702*b* could be configured to accept physical barrier gates to prevent personnel from falling off a side of the deck platform 700.

In various embodiments, the deck platform 700 could be operated in a manual fashion. In such scenarios, to open (e.g., raise) the deck platform 700, personnel may:

1). Place physical barrier gates (e.g., popsicle sticks) in adjacent flip door stake pockets.

2Using a "shepherd's hook" tool, hook into eyelet 704 to rotate flip door up to 90 degrees into a "raised" configuration.

3). Toggle spring-loaded lock pin lever (e.g., locking mechanism 160) to the right within the groove opening 124 to engage flip door in vertical orientation.

4). Pull on handrail until guardrail self-deploys and latches into an extended guardrail configuration.

In various embodiments, to close (e.g., lower) the deck platform 700, personnel may:

1). Pull on the guardrail release latch (e.g., guardrail release mechanism 180) to release the flip door from the raised position.

2). Push down on the guardrail until it collapses into the retracted guardrail configuration.

3). Pull up on the flip door lock pin lever (e.g., locking mechanism 160) and toggle to the left to the hold position.

4). Release door and allow it to arrest back to closed position.

5). Remove physical barrier gates (e.g., popsicle sticks) from adjacent flip door stake pockets and move to storage area.

In some embodiments, the deck platform 700 may be configured to flip substantially 180 degrees into a load/unload configuration. For example, in such scenarios, personnel may:

1). Utilize a "shepard's hook" tool to hook into flip door eyelet 704 and pull up on flip door.

2). Rotate flip door 180 degrees and disengage "shepard's hook" tool for load/unload as needed.

3). After completing load/unload processes, rotate flip door back to upward position (e.g., 90 degrees) and then release locking pin to allow flip door to arrest into closed position.

Figure 8A:
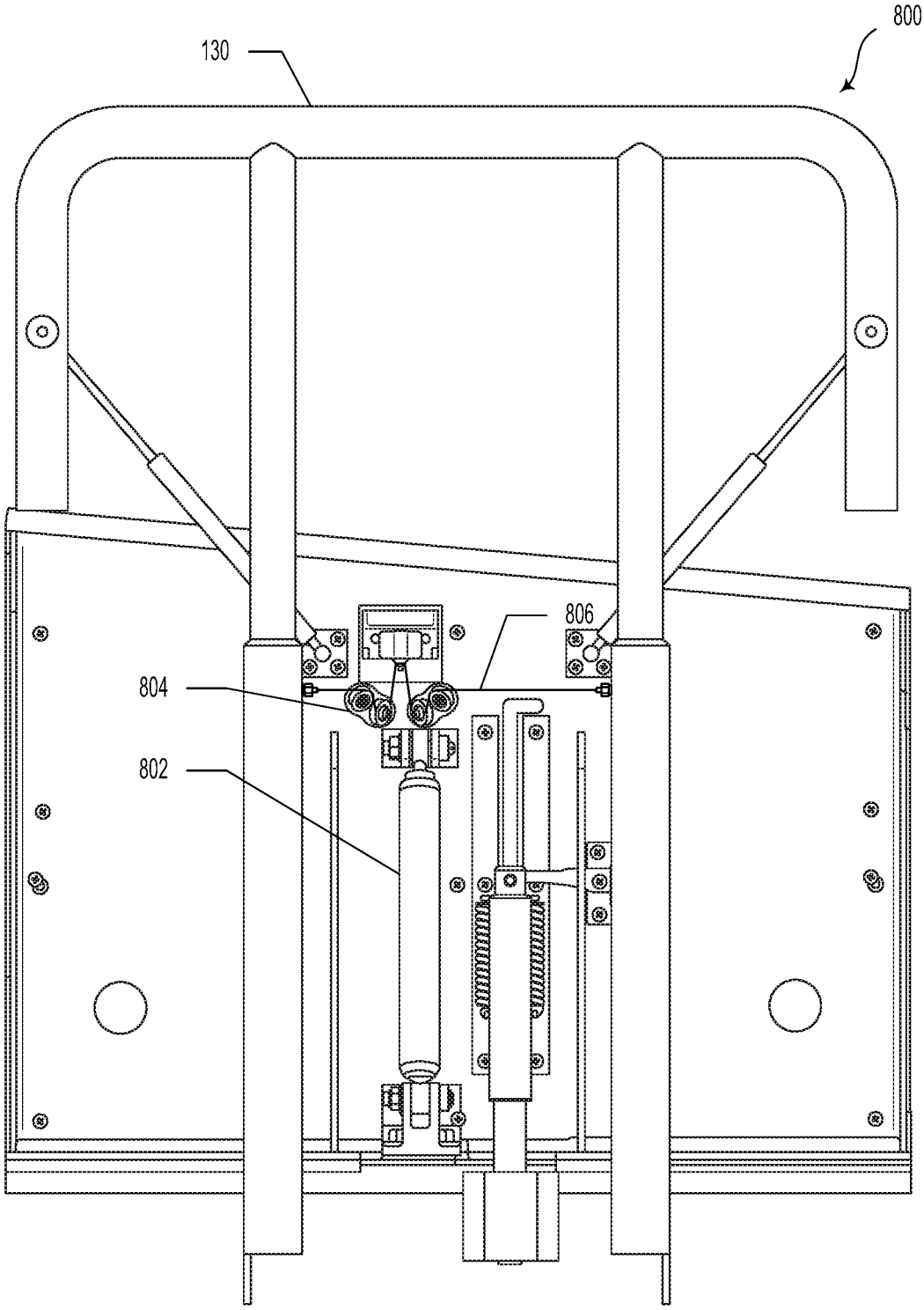
FIG. 8A illustrates a deck platform, according to an example implementation.
Figure 8B:
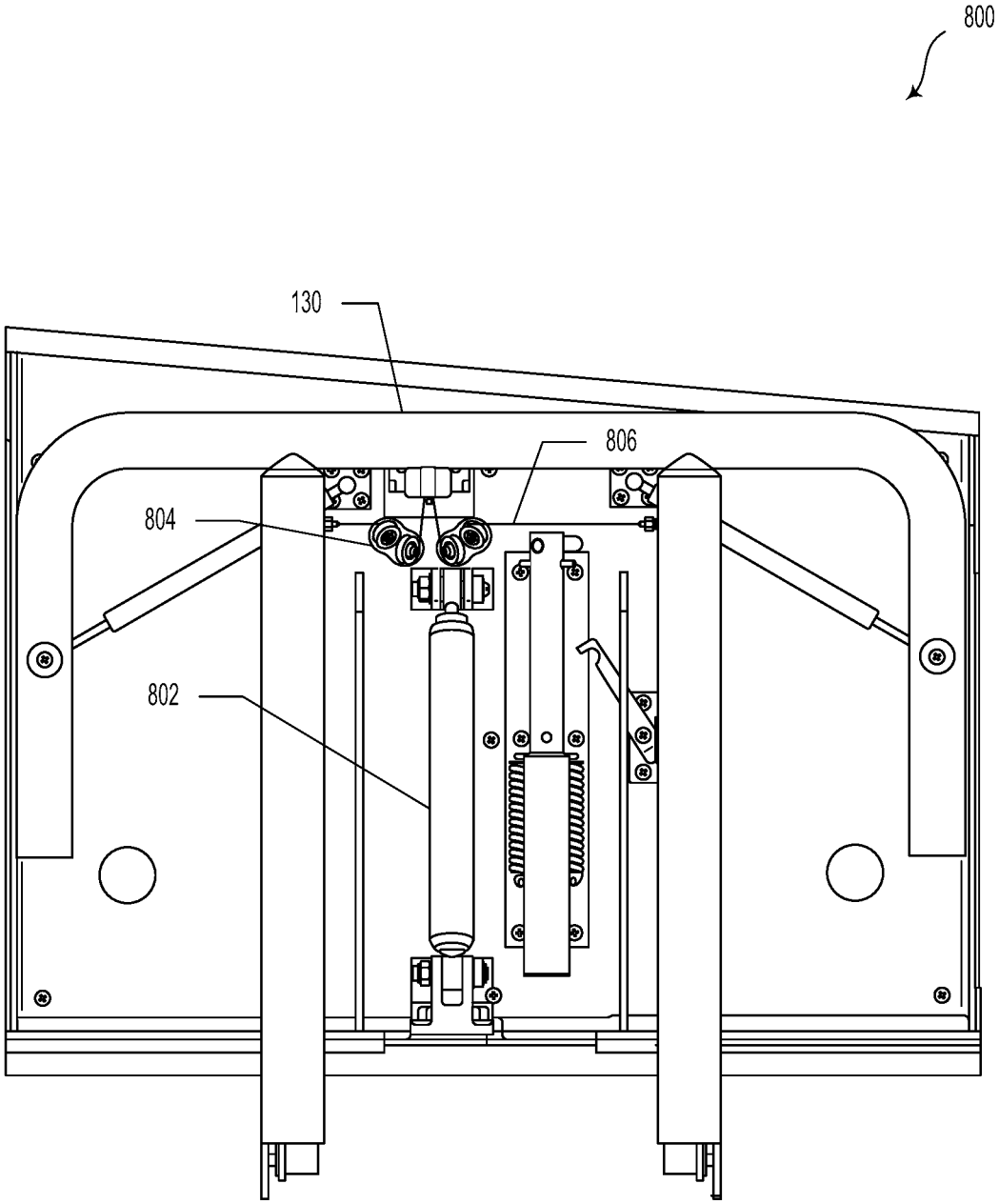
FIG. 8B illustrates a deck platform, according to an example implementation.

FIGS. 8A and 8B illustrate a deck platform 800, according to an example implementation. Deck platform 800 may be similar or identical to deck platform 700 except in that a back plate (e.g., back plate 710) may be removed for illustrative purposes. Furthermore, in some embodiments, deck platform 800 could be operated utilizing mechanical assistance, as described herein.

In various embodiments, deck platform 800 may include a dampener 802 configured to ease the flip door into deployed (lowered) and/or raised positions. In other words, the dampener 802 may include a gas spring or another type of opposing force to prevent/avoid abrupt "slamming" or falling of the flip door.

Additionally or alternatively, deck platform 800 may include a cable guide assembly 804. The cable guide assembly 804 may include one or more pulleys and/or sprockets configured to guide a wire cable 806. For example, the wire cable 806 could be configured to help raise and/or lower the guard rail.

Figure 8C:
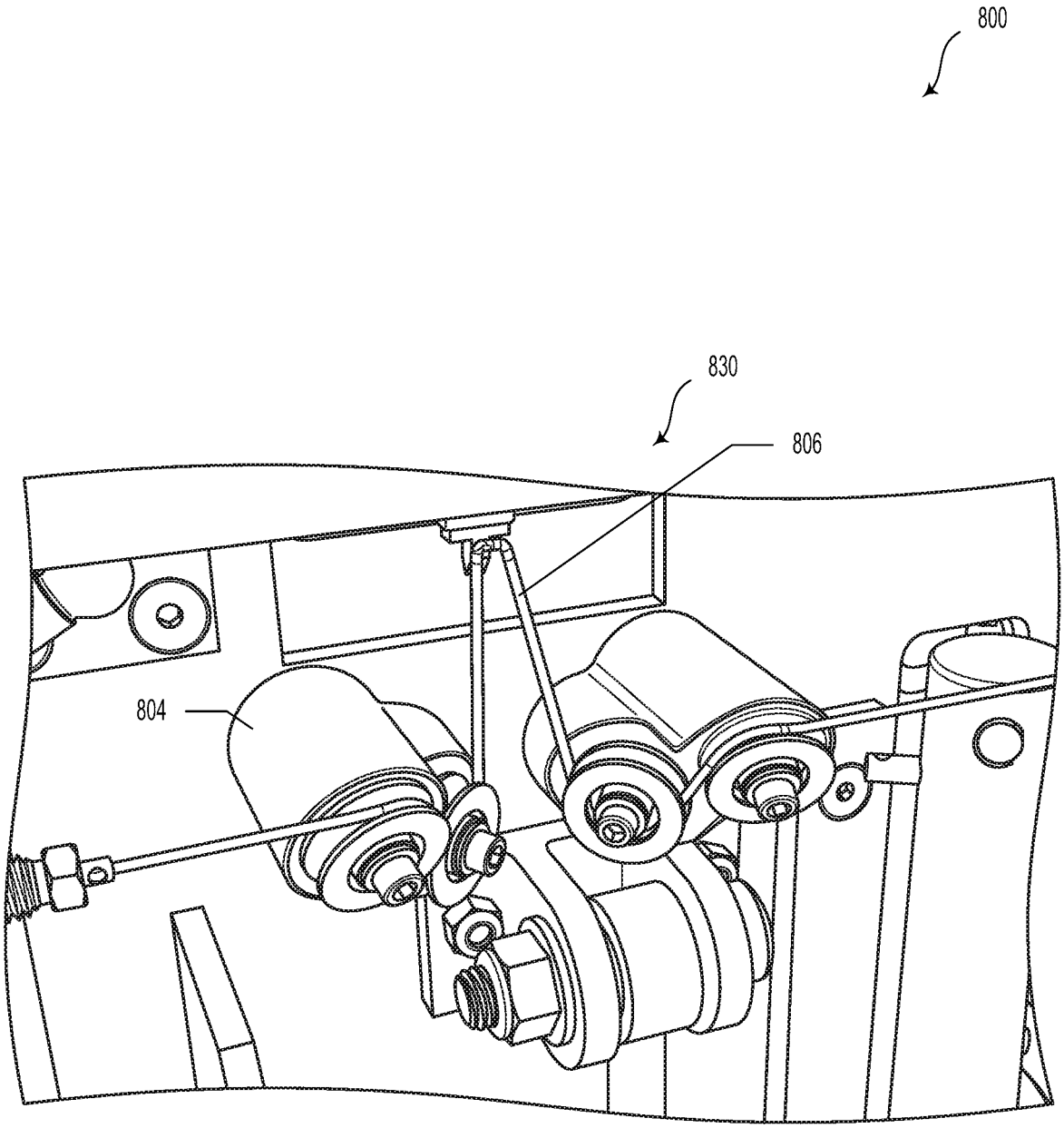
FIG. 8C illustrates a portion of a deck platform, according to an example implementation.
Figure 8D:
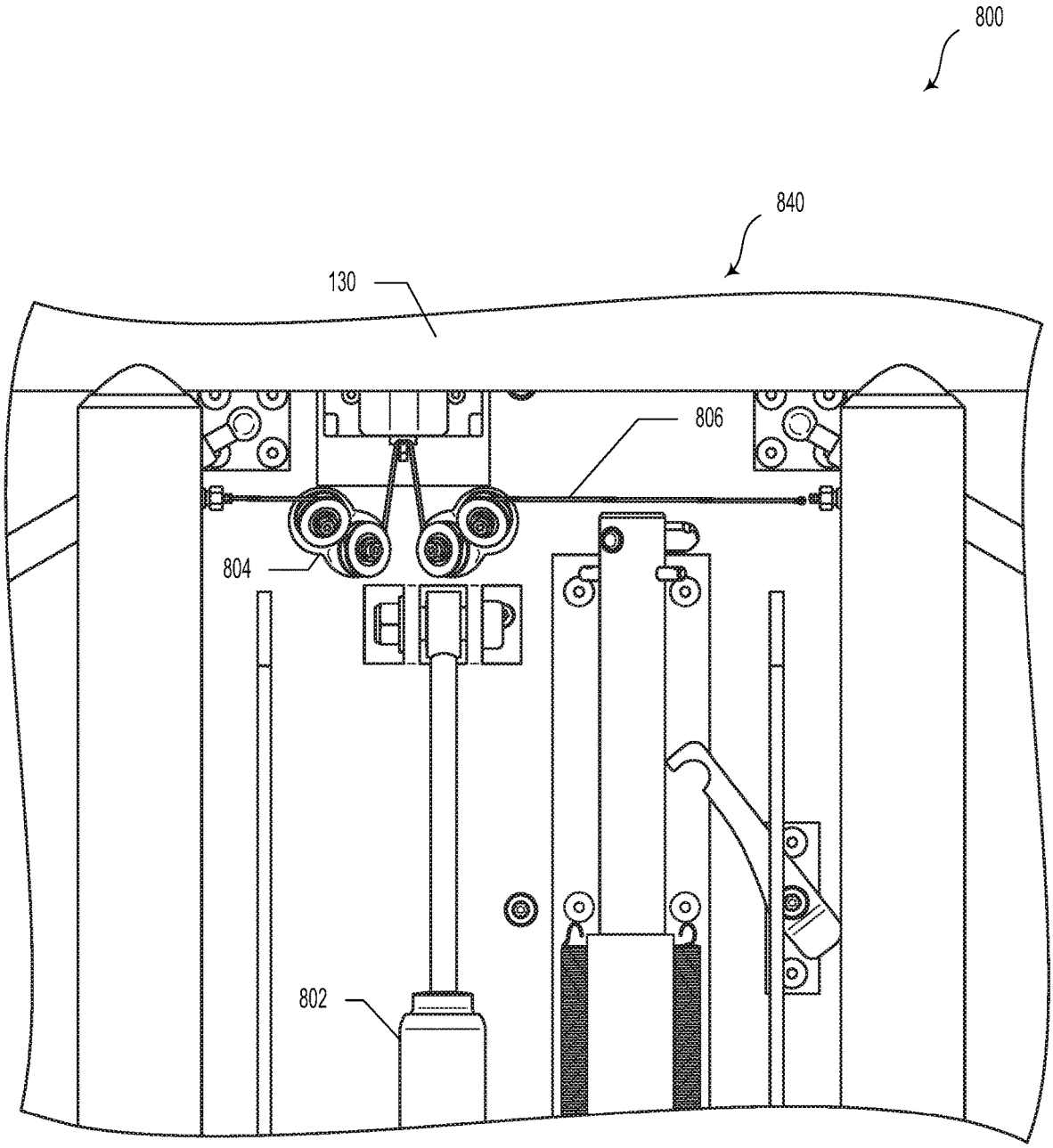
FIG. 8D illustrates a portion of a deck platform, according to an example implementation.

FIGS. 8C and 8D illustrate portions 830 and 840 of a deck platform 800, according to an example implementation.

Figure 9:
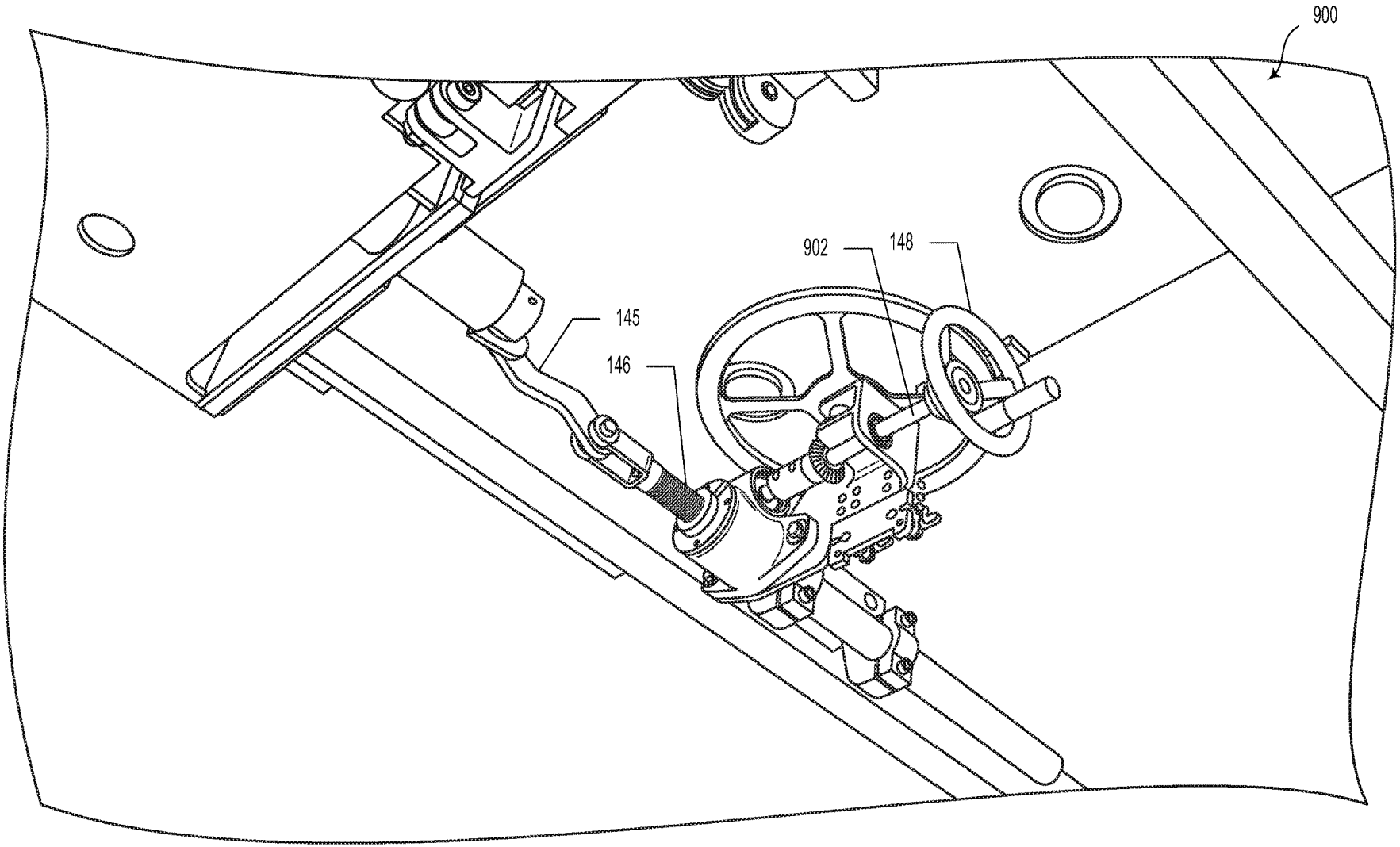
FIG. 9 illustrates a portion of a deck platform, according to an example implementation.

FIG. 9 illustrates a portion 900 of a deck platform 800, according to an example implementation. In some embodiments, deck platform 800 may include a hand crank 148 coupled to a shaft 902.

For example, to "open" (e.g., raise) the deck platform 800, personnel may:

1). Place physical barrier gates (e.g., popsicle sticks) into adjacent flip door stake pockets.

2). Located flip door "hand crank" access.

3). Visually inspect to verify "popsicle sticks" are fully engaged in adjacent flip door stake pockets.

4). Rotate hand crank 148 clockwise to raise flip door and telescoping guardrail to a deployed (raised/extended) configuration.

In some embodiments, to "close" (e.g., lower) the deck platform 800, personnel may:

1). Rotate the hand crank 148 counter clockwise until flip door and telescoping guardrail have returned to a collapsed (retracted) position.

2). Remove popsicle sticks and place in storage area.

To provide 180 degree "load/unload" operations, personnel may:

1). Rotate hand crank 148 until vertical flip door configuration is obtained, and then continue rotating the hand crank 148 clockwise until flip door and telescoping guardrail have collapsed back to the 180 degree "load/unload" position.

2). Rotate hand crank 148 counter clockwise up to cause the flip door to reach vertical deployed position and then continue counter clockwise rotation of the hand crank 148 until telescoping guardrail and flip door have returned to collapsed (lowered) position.

Figure 10A:
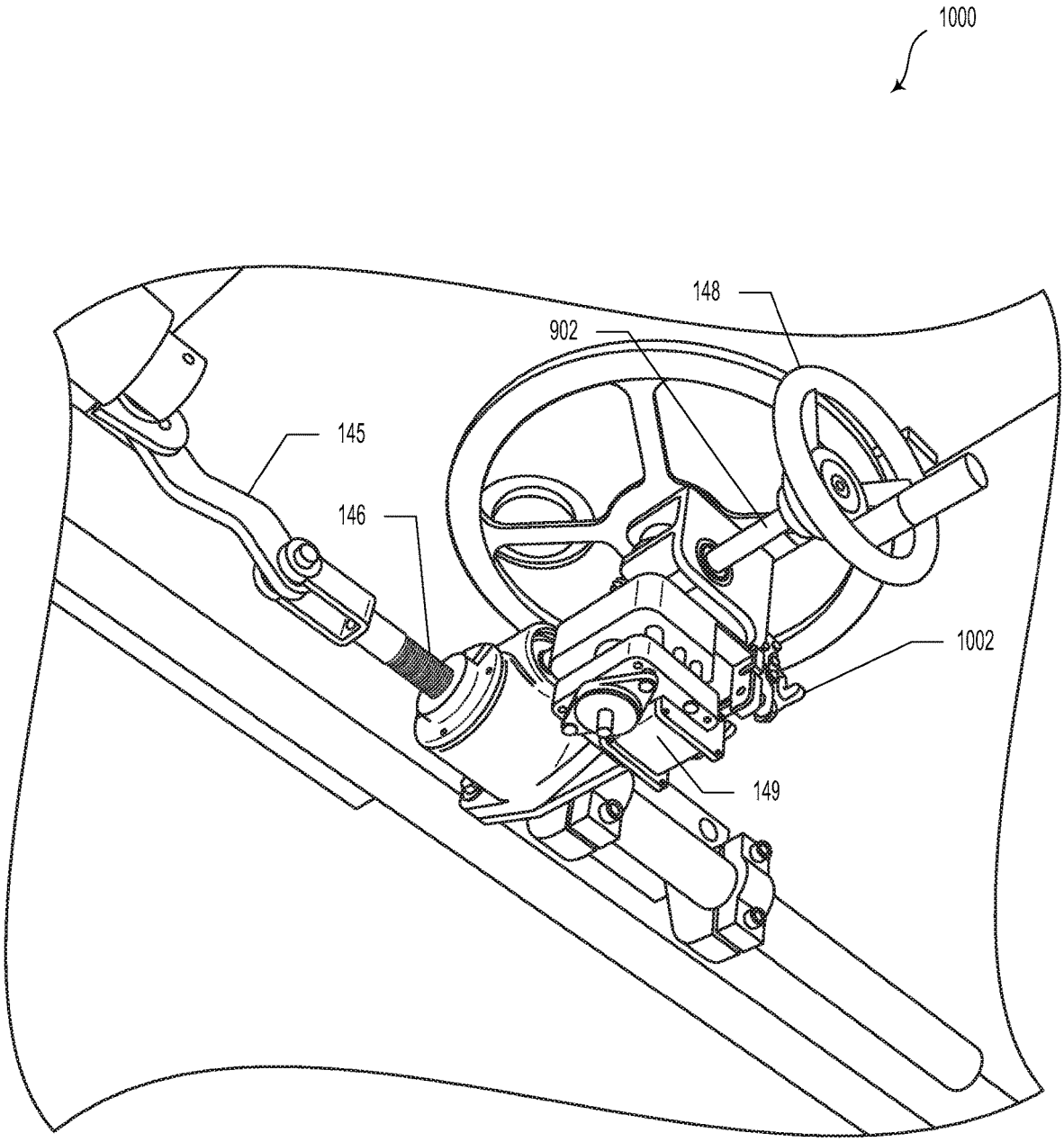
FIG. 10A illustrates a portion of a deck platform, according to an example implementation.

FIG. 10A illustrates a portion 1000 of a deck platform 800, according to an example implementation.

Figure 10B:
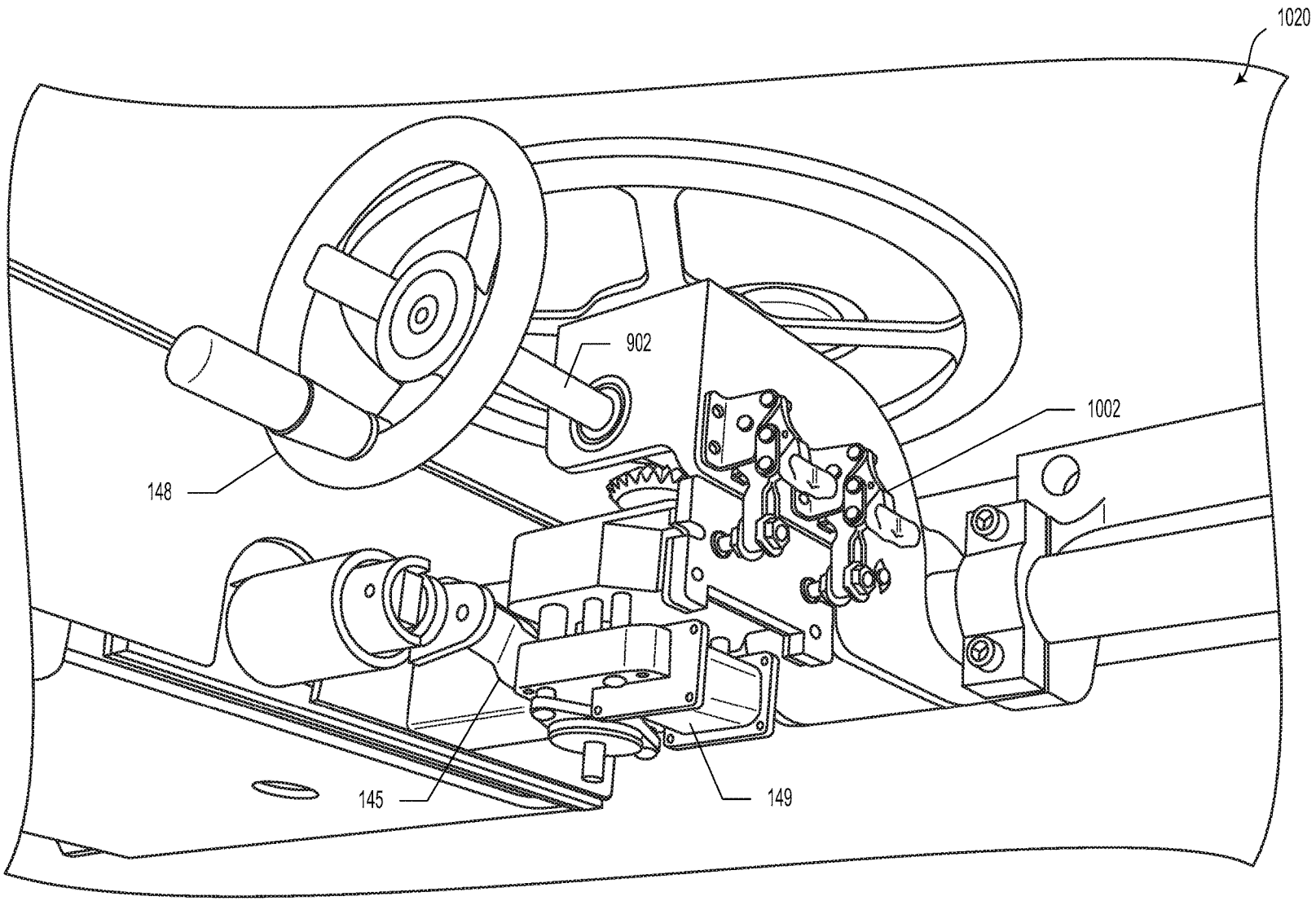
FIG. 10B illustrates a portion of a deck platform, according to an example implementation.

FIG. 10B illustrates a portion 1020 of a deck platform 800, according to an example implementation.

While several embodiments described and illustrated herein describe either manual operation or mechanically-assisted (e.g., hand crank) operation, it will be understood that "fully-automated" operation is also possible and contemplated here.

For example, the deck platform 800 or other systems described herein may include an electric motor 149 that could be installed and integrated onto the shaft 902 of the hand crank 148. In some embodiments, the electric motor 149 could be coupled to the shaft 902 via a quick disconnect 1002 to provide a way for personnel to operate the hand crank 148 in case of motor failure.

In such embodiments, a mechanical linkage (e.g., link arm 145 and push rod 146) may be configured to rotate the flip door and/or deploy the telescoping guardrail in a single, fluid motion. Furthermore, the electric motor 149 could be controlled by the remote unit 170, or another control mechanism.

In some embodiments, programmable logic may be utilized to provide a safety interlock system. The safety interlock system may provide improved (e.g., redundant) safety for personnel by detecting whether physical barrier gates (e.g., popsicle sticks) are within stake pockets of adjacent flip doors before actuating a particular flip door.

The integration of programmable logic may relieve some or all tie-off requirements for personnel. Furthermore, full automation of load/unload and flip door operation may reduce potential hazards for personnel and/or reduce the risk of injury.

Figure 11A:
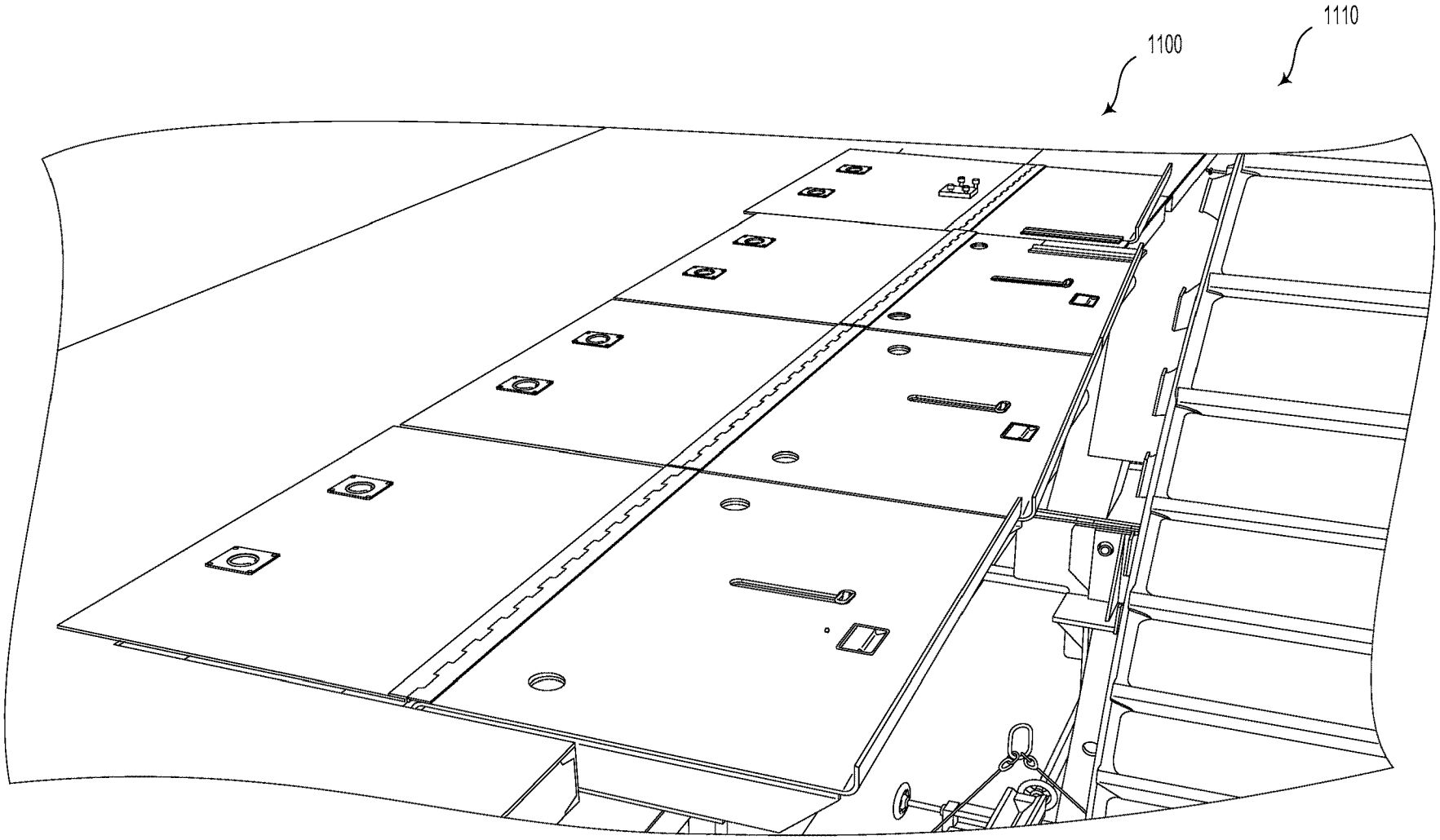
FIG. 11A illustrates several deck platforms, according to an example implementation.

FIG. 11A illustrates several deck platforms 1100 in a platform configuration 1110, according to an example implementation.

Figure 11B:
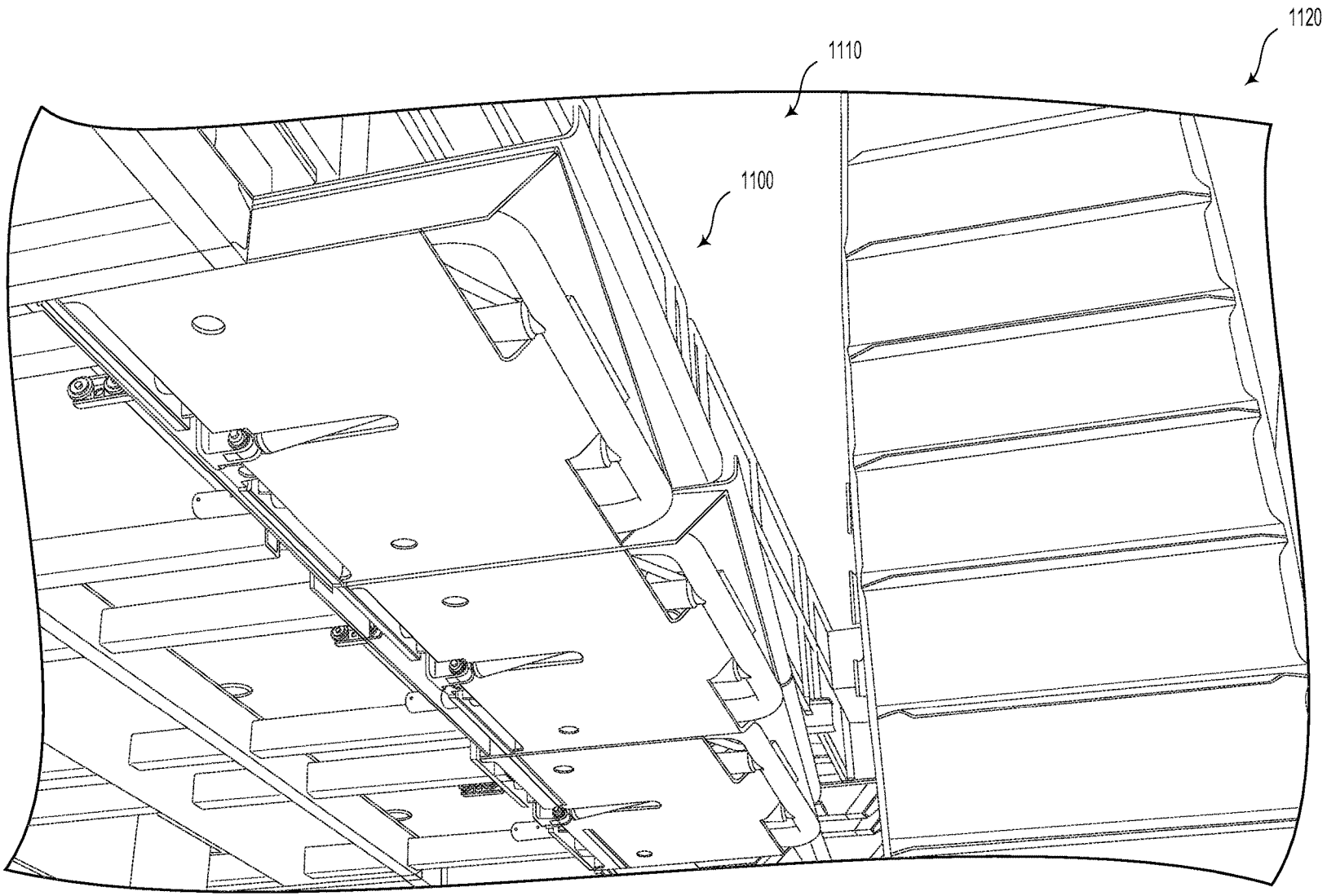
FIG. 11B illustrates several deck platforms, according to an example implementation.

FIG. 11B illustrates an alternative view 1120 of the several deck platforms 1100 in a platform configuration 1110, according to an example implementation.

Figure 11C:
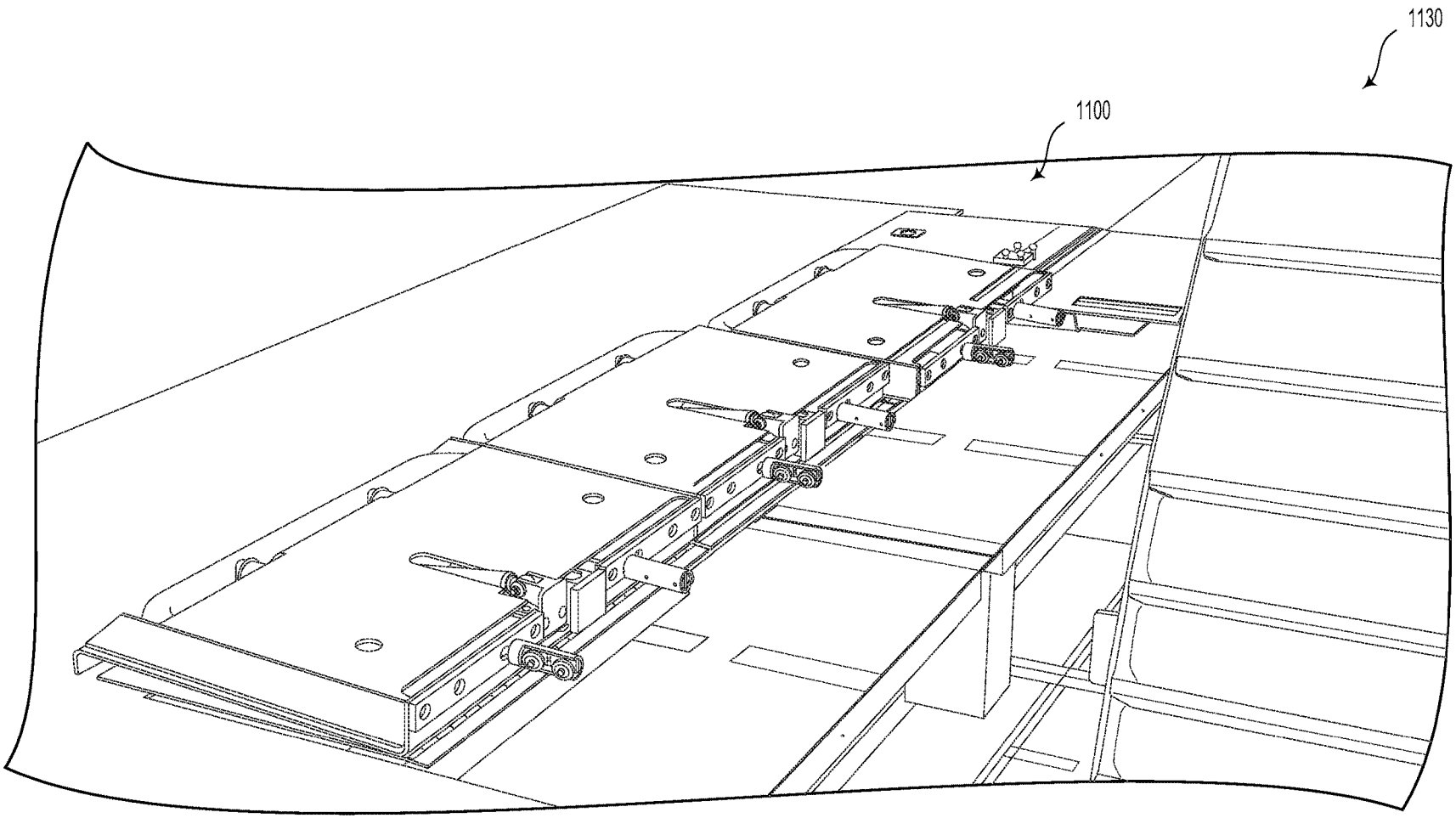
FIG. 11C illustrates several deck platforms, according to an example implementation.

FIG. 11C illustrates several deck platforms 1100 in a flipped-back configuration 1130, according to an example implementation.

Figure 12A:
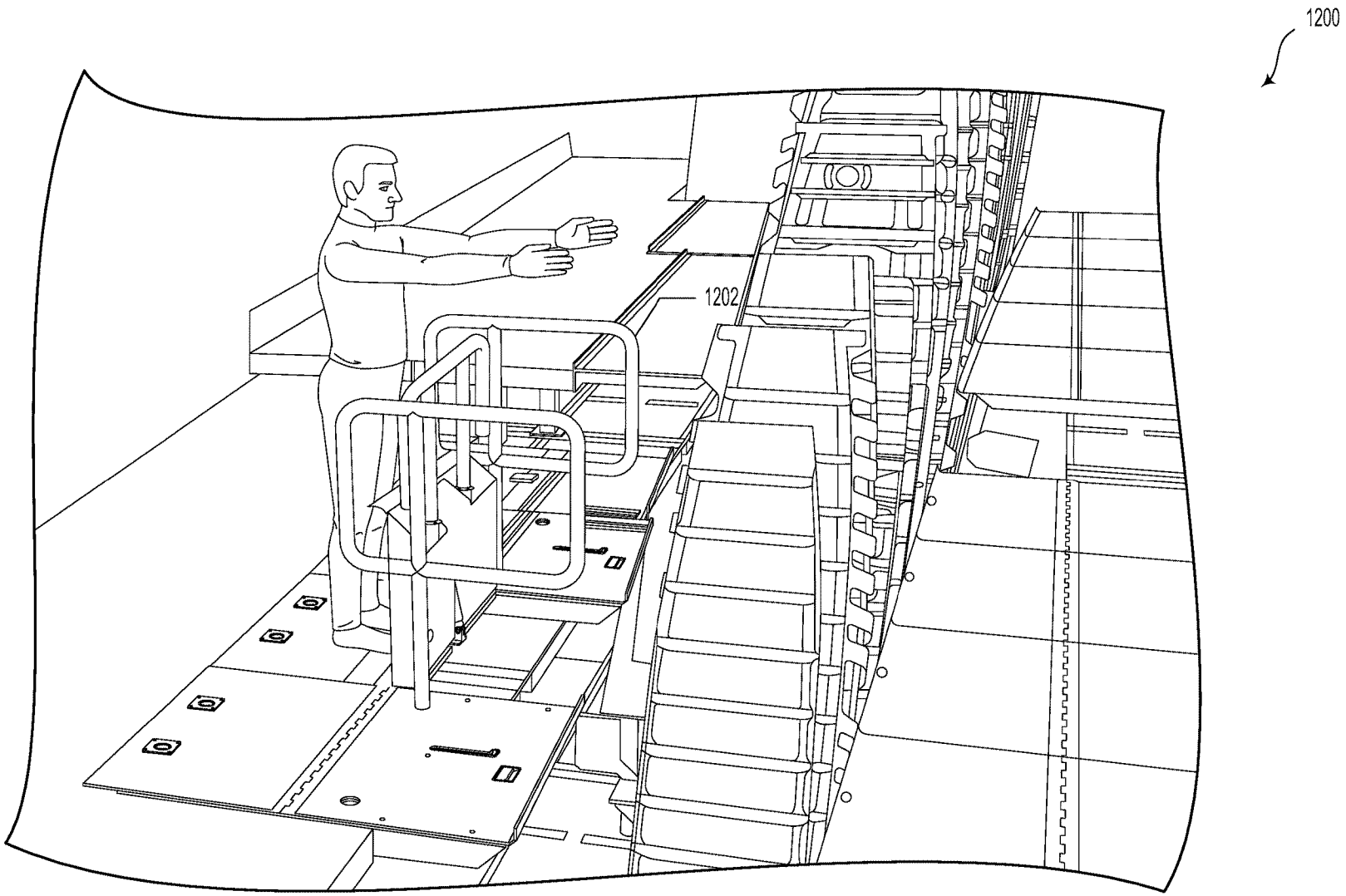
FIG. 12A illustrates an operating scenario, according to an example implementation.
Figure 12B:
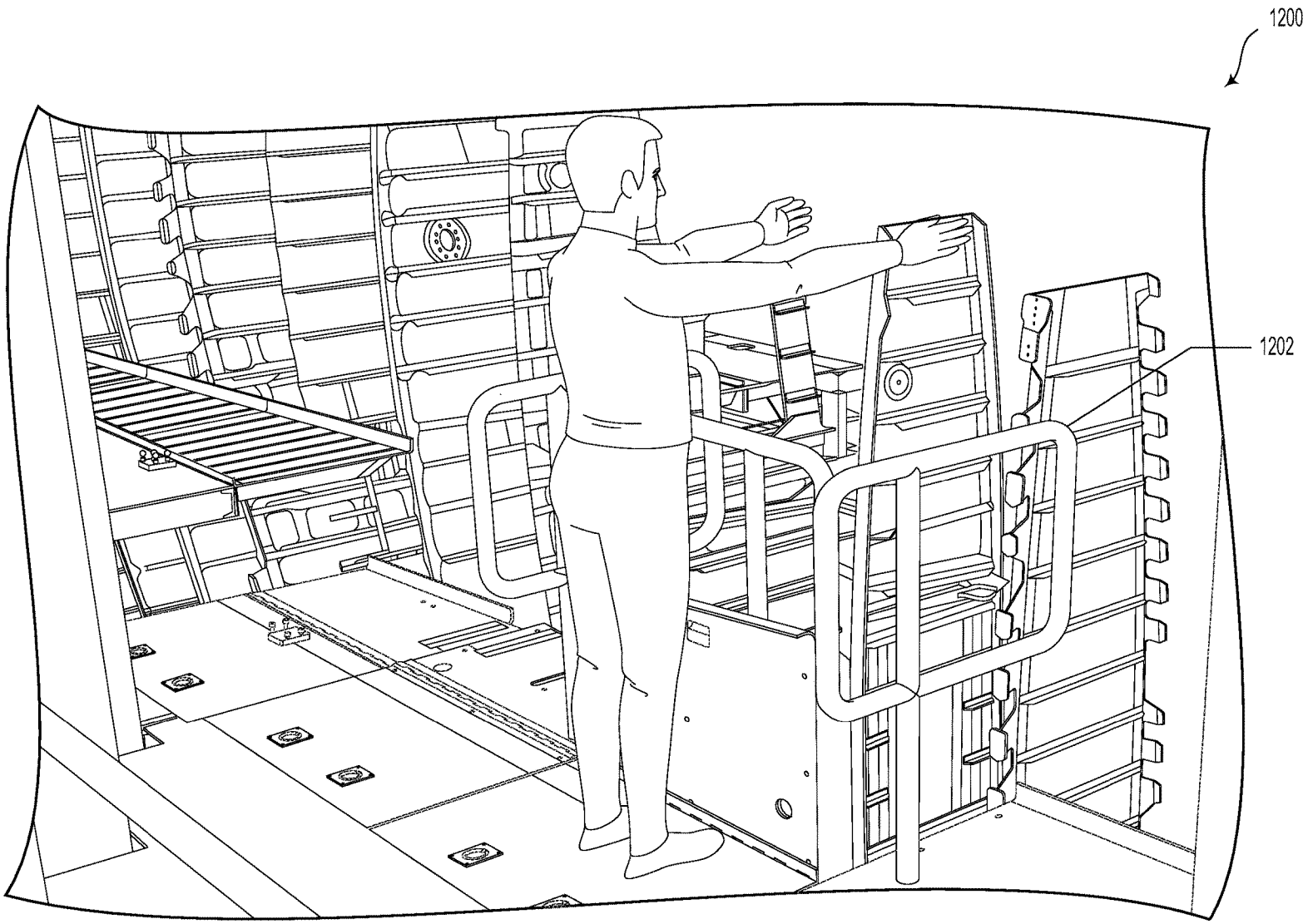
FIG. 12B illustrates an operating scenario, according to an example implementation.
Figure 12C:
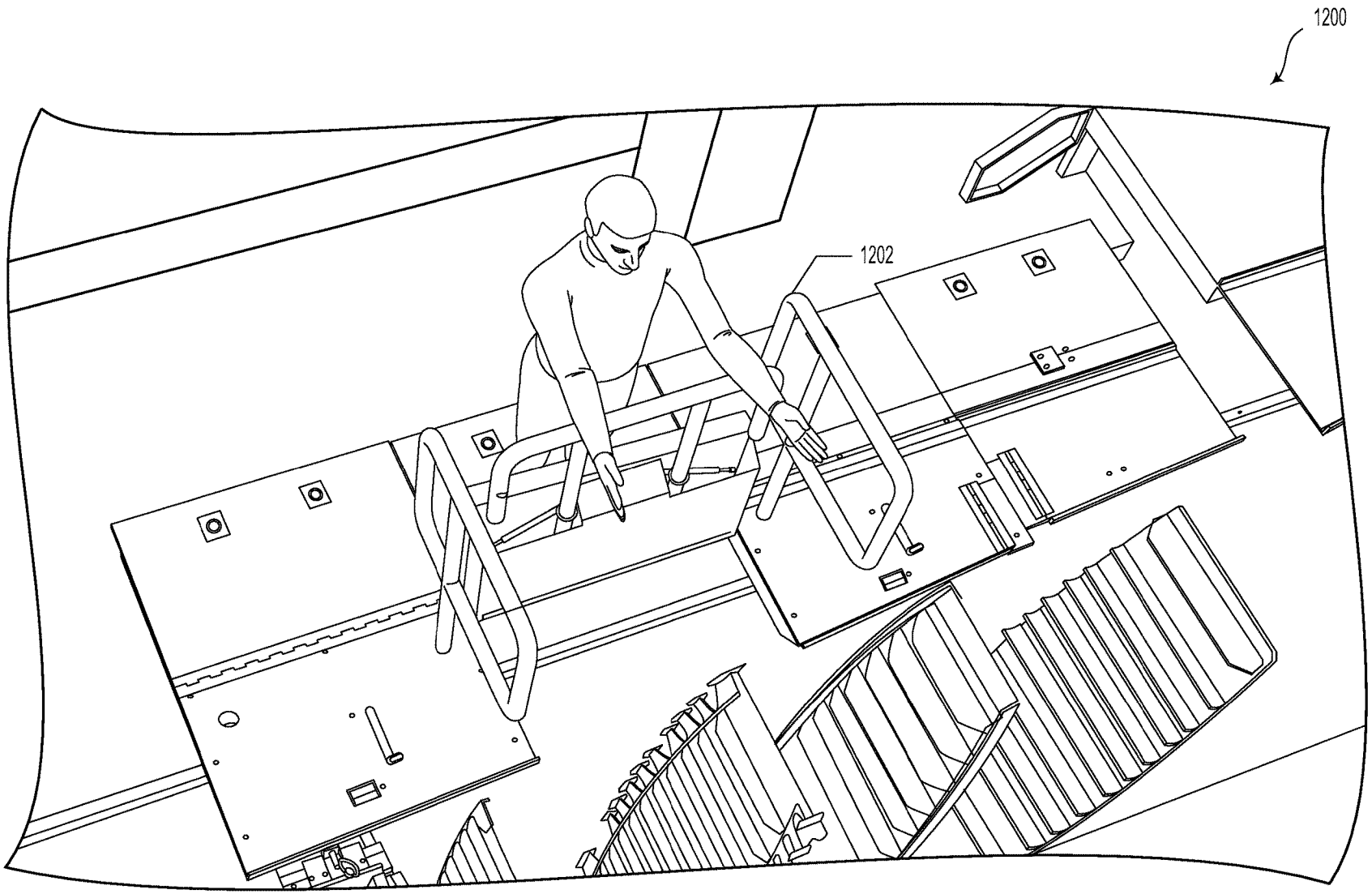
FIG. 12C illustrates an operating scenario, according to an example implementation.

FIGS. 12A-12C illustrate various views of an operating scenario 1200, according to an example implementation. As described herein, various operating scenarios could include installation of one or more physical barrier gates 1202 to prevent personnel from falling into open portions of the deck platform.

The particular arrangements shown in the Figures should not be viewed as limiting. It should be understood that other embodiments may include more or less of each element shown in a given Figure. Further, some of the illustrated elements may be combined or omitted. Yet further, an illustrative embodiment may include elements that are not illustrated in the Figures.

A step or block that represents a processing of information can correspond to circuitry that can be configured to perform the specific logical functions of a herein-described method or technique. Alternatively or additionally, a step or block that represents a processing of information can correspond to a module, a segment, or a portion of program code (including related data). The program code can include one or more instructions executable by a processor for implementing specific logical functions or actions in the method or technique. The program code and/or related data can be stored on any type of computer readable medium such as a storage device including a disk, hard drive, or other storage medium.

The computer readable medium can also include non-transitory computer readable media such as computer-readable media that store data for short periods of time like register memory, processor cache, and random access memory (RAM). The computer readable media can also include non-transitory computer readable media that store program code and/or data for longer periods of time. Thus, the computer readable media may include secondary or persistent long term storage, like read only memory (ROM), optical or magnetic disks, compact-disc read only memory (CD-ROM), for example. The computer readable media can also be any other volatile or non-volatile storage systems. A computer readable medium can be considered a computer readable storage medium, for example, or a tangible storage device.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

What is claimed is:

1. A system comprising:

a bracket configured to be coupled to a fixed structure having a walking surface;

a flip door portion rotatably coupled to the bracket;

a guardrail portion extendibly coupled to the flip door portion;

a telescopic linkage further coupling the flip door portion to the guardrail portion; and a locking mechanism with a locking pin, wherein the locking pin is configured to maintain the flip door portion in a raised configuration, wherein the system is configured to be adjusted between the raised configuration and a platform configuration.

2. The system of claim 1, wherein the walking surface defines a reference plane, wherein the raised configuration comprises the flip door portion disposed substantially perpendicular to the reference plane and the guardrail portion being extended away from the flip door portion.

3. The system of claim 1, wherein the walking surface defines a reference plane, wherein the platform configuration comprises the flip door portion extending substantially parallel along the reference plane and the guardrail portion being stowed under a top surface of the flip door portion.

4. The system of claim 1, wherein the guardrail portion comprises:

a top rail; and a plurality of extendible posts coupled to the top rail and the flip door portion.

5. The system of claim 1, wherein the telescopic linkage comprises a plurality of gas springs that are configured to provide an extending force between the guardrail portion and the flip door portion.

6. The system of claim 1, wherein the locking mechanism is operable through a groove opening of a top surface of the flip door portion.

7. The system of claim 1, further comprising a guardrail release mechanism configured to operably maintain the guardrail portion in a retracted guardrail configuration or release the guardrail portion to an extended guardrail configuration, wherein the guardrail release mechanism is operable by way of a guardrail release handle, wherein the guardrail release handle is operable from a top surface of the flip door portion.

8. The system of claim 7, further comprising a guardrail retention device, wherein the guardrail retention device is configured to retain the guardrail portion in the retracted guardrail configuration, wherein the guardrail release mechanism is configured to operably release the guardrail retention device.

9. The system of claim 1, further comprising a latching device, wherein the latching device is configured to allow operation of the locking mechanism only if the guardrail portion is in a retracted guardrail configuration.

10. The system of claim 1, further comprising a flip door actuation mechanism configured to move the flip door portion between the raised configuration and the platform configuration.

11. The system of claim 10, wherein the flip door actuation mechanism comprises:

a link arm coupled to the flip door portion;

a push rod coupled to the link arm; and gearing coupled to the push rod.

12. The system of claim 11, wherein the flip door actuation mechanism further comprises a hand crank coupled to the gearing, wherein the hand crank is accessible from a top surface of the flip door portion.

13. The system of claim 11, wherein the flip door actuation mechanism further comprises an electric motor coupled to the gearing.

14. The system of claim 10, further comprising a controller having at least one processor and a memory, wherein the at least one processor executes program instructions stored in the memory so as to carry out operations, the operations comprising:

causing the flip door actuation mechanism to controllably move the flip door portion between the raised configuration and the platform configuration.

15. The system of claim 14, wherein the operations further comprise:

causing the guardrail portion to controllably move between a retracted guardrail configuration and an extended guardrail configuration.

16. The system of claim 14, further comprising a remote unit configured to control a configuration of the system, wherein the remote unit comprises a wired remote controller having a user interface, wherein the user interface comprises at least one button.

17. A deck platform comprising:

a fixed deck platform portion comprising a walking surface;

a movable deck platform portion comprising:

a bracket configured to be coupled to the fixed deck platform portion;

a flip door portion rotatably coupled to the bracket;

a guardrail portion extendibly coupled to the flip door portion;

a telescopic linkage further coupling the flip door portion to the guardrail portion; and a locking mechanism with a locking pin, wherein the locking pin is configured to maintain the flip door portion in a raised configuration, wherein the movable deck platform portion is configured to be adjusted between the raised configuration and a platform configuration.

18. The deck platform of claim 17, wherein the walking surface defines a reference plane, wherein the raised configuration comprises the flip door portion disposed substantially perpendicular to the reference plane and the guardrail portion being extended away from the flip door portion, and wherein the platform configuration comprises the flip door portion extending substantially parallel along the reference plane and the guardrail portion being stowed under a top surface of the flip door portion.

19. A method comprising:

receiving, from a remote unit, information indicative of a desired configuration or a desired movement of a flip door portion and a guardrail portion with respect to a fixed structure having a walking surface, wherein the flip door portion is rotatably coupled to a bracket attached to the fixed structure, wherein the guardrail portion is rotatably coupled to the flip door portion;

determining, based on the received information, that the desired configuration or the desired movement comprises at least one of: a raised configuration or a platform configuration with respect to the walking surface; and moving the flip door portion and the guardrail portion according to the desired configuration or the desired movement.

20. The method of claim 19, further comprising at least one of:

i) in response to determining the desired movement comprises the raised configuration:

rotating the flip door portion upward with respect to the walking surface of the fixed structure;

releasing a guardrail release mechanism; and extending the guardrail portion with respect to the flip door portion; or ii) in response to determining the desired movement comprises the platform configuration:

retracting the guardrail portion with respect to the flip door portion;

engaging a guardrail retention device; and rotating the flip door portion downward with respect to the walking surface of the fixed structure.

* * * * *